US009453388B2

(12) United States Patent
Tahoun et al.

(10) Patent No.: US 9,453,388 B2
(45) Date of Patent: Sep. 27, 2016

(54) APPARATUS AND METHOD TO REMOTELY CONTROL FLUID FLOW IN TUBULAR STRINGS AND WELLBORE ANNULUS

(71) Applicants: Ahmed M Tahoun, Agawam, MA (US); Raed Kafafy, KL (MY); Karam Jawamir, KL (MY); Mohammed Aldheeb, KL (MY); Abdul Mushawwir Mohamad Khalil, KL (MY)

(72) Inventors: Ahmed M Tahoun, Agawam, MA (US); Raed Kafafy, KL (MY); Karam Jawamir, KL (MY); Mohammed Aldheeb, KL (MY); Abdul Mushawwir Mohamad Khalil, KL (MY)

(73) Assignee: MIT Innovation Sdn Bhd, Petroliam Nasional Berhad (PETRONAS)

( * ) Notice: Subject to any disclaimer, the term of this patent is extended or adjusted under 35 U.S.C. 154(b) by 426 days.

(21) Appl. No.: 13/846,946

(22) Filed: Mar. 18, 2013

(65) Prior Publication Data

US 2014/0124195 A1 May 8, 2014

Related U.S. Application Data

(60) Provisional application No. 61/622,572, filed on Apr. 11, 2012, provisional application No. 61/710,887, filed on Oct. 8, 2012, provisional application No. 61/710,823, filed on Oct. 8, 2012, provisional application No. 61/648,575, filed on May 17, 2012.

(51) Int. Cl.

| | |
|---|---|
| ***E21B 47/18*** | (2012.01) |
| ***E21B 34/08*** | (2006.01) |
| ***E21B 34/12*** | (2006.01) |
| ***E21B 47/12*** | (2012.01) |
| ***E21B 21/10*** | (2006.01) |
| ***E21B 23/00*** | (2006.01) |
| ***E21B 34/06*** | (2006.01) |
| ***E21B 41/00*** | (2006.01) |
| *E21B 34/00* | (2006.01) |

(52) U.S. Cl.

CPC ..... *E21B 34/08* (2013.01); *E21B 21/103* (2013.01); *E21B 23/006* (2013.01); *E21B 34/06* (2013.01); *E21B 34/066* (2013.01); *E21B 34/12* (2013.01); *E21B 41/0085* (2013.01); *E21B 47/12* (2013.01); *E21B 47/122* (2013.01); *E21B 47/18* (2013.01); *E21B 2034/002* (2013.01); *E21B 2034/007* (2013.01)

(58) Field of Classification Search

CPC ..... E21B 2034/002; E21B 21/103; E21B 23/006; E21B 34/066; E21B 34/12; E21B 34/05; E21B 41/0085; E21B 47/18; E21B 47/122; F16K 11/0876; F16K 11/0873; F16K 5/201

See application file for complete search history.

(56) References Cited

U.S. PATENT DOCUMENTS

| | | | | | |
|---|---|---|---|---|---|
| 2,894,715 | A | * | 7/1959 | Bostock | 251/58 |
| RE25,471 | E | * | 11/1963 | Giroux | 251/31 |
| 3,398,928 | A | * | 8/1968 | Fredd | 251/251 |
| 3,533,430 | A | * | 10/1970 | Fredd | 137/112 |
| 3,543,793 | A | * | 12/1970 | Dollison | 137/614.2 |

(Continued)

*Primary Examiner* — Jennifer H Gay

(57) ABSTRACT

A method and apparatus for remotely and selectively controlling and altering fluid flow through tubular string disposed within a wellbore and further control fluid flow between the tubular string inner flow passage and the annular flow passage, and a method for selectively and remotely receiving and interpreting a form of command or information at a particular apparatus within the wellbore caused by the operator on earth surface through a change of a physical property of the environment. The apparatus comprising a body, a valve operable in plurality of states, an actuator, and an activator responsive to a change of a physical property of the environment caused by the operator on earth surface.

6 Claims, 23 Drawing Sheets

(56) References Cited

U.S. PATENT DOCUMENTS

| | | | | | |
|---|---|---|---|---|---|
| 3,666,012 | A * | 5/1972 | Sizer et al. | 166/319 |
| 3,814,182 | A * | 6/1974 | Giroux | 166/331 |
| 3,971,438 | A * | 7/1976 | Crowe | 166/324 |
| RE29,471 | E * | 11/1977 | Giroux | 166/334.2 |
| 4,291,722 | A * | 9/1981 | Churchman | 137/496 |
| 4,399,870 | A * | 8/1983 | Baugh et al. | 166/324 |
| 4,458,751 | A * | 7/1984 | Haynes | 166/133 |
| 5,050,681 | A * | 9/1991 | Skinner | 166/374 |
| 5,439,052 | A * | 8/1995 | Skinner | 166/85.2 |
| 5,484,022 | A * | 1/1996 | Coutts et al. | 166/336 |
| 5,649,597 | A * | 7/1997 | Ringgenberg | 166/373 |
| 5,894,890 | A * | 4/1999 | Garcia-Soule et al. | 166/356 |
| 6,095,249 | A * | 8/2000 | McGarian et al. | 166/319 |
| 6,662,886 | B2 * | 12/2003 | Russell | 175/218 |
| 7,712,724 | B2 * | 5/2010 | Thomas | 251/314 |
| 8,201,804 | B2 * | 6/2012 | Strazhgorodskiy | 251/183 |
| 2001/0042619 | A1 * | 11/2001 | Gatherar et al. | 166/86.3 |
| 2004/0007361 | A1 * | 1/2004 | McGarian et al. | 166/319 |
| 2007/0119594 | A1 * | 5/2007 | Turner et al. | 166/319 |
| 2008/0029306 | A1 * | 2/2008 | Krueger et al. | 175/210 |
| 2008/0315144 | A1 * | 12/2008 | Thomas | 251/315.1 |
| 2009/0242817 | A1 * | 10/2009 | Strazhgorodskiy | 251/315.16 |
| 2010/0193196 | A1 * | 8/2010 | McGarian | 166/373 |
| 2010/0252276 | A1 * | 10/2010 | Clausen et al. | 166/381 |
| 2011/0048806 | A1 * | 3/2011 | Fincher et al. | 175/57 |
| 2011/0083857 | A1 * | 4/2011 | Knobloch et al. | 166/373 |
| 2011/0297380 | A1 * | 12/2011 | Alberty et al. | 166/301 |
| 2012/0067594 | A1 * | 3/2012 | Noske et al. | 166/373 |
| 2012/0199210 | A1 * | 8/2012 | Osborne | 137/1 |
| 2013/0025711 | A1 * | 1/2013 | Russell | 137/512 |
| 2013/0062124 | A1 * | 3/2013 | Roders et al. | 175/46 |
| 2013/0133891 | A1 * | 5/2013 | Getzlaf et al. | 166/308.1 |
| 2013/0269951 | A1 * | 10/2013 | Tahoun et al. | 166/373 |
| 2013/0327537 | A1 * | 12/2013 | Anyan et al. | 166/373 |
| 2014/0124195 | A1 * | 5/2014 | Tahoun et al. | 166/250.01 |

* cited by examiner

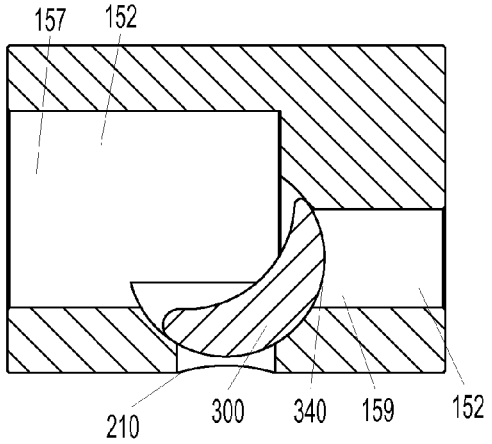
FIG. 7A1
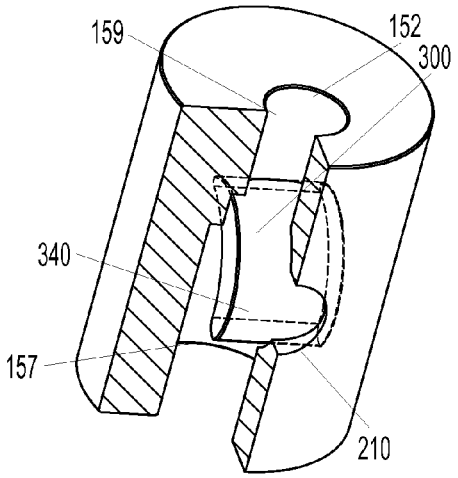
FIG. 7A2
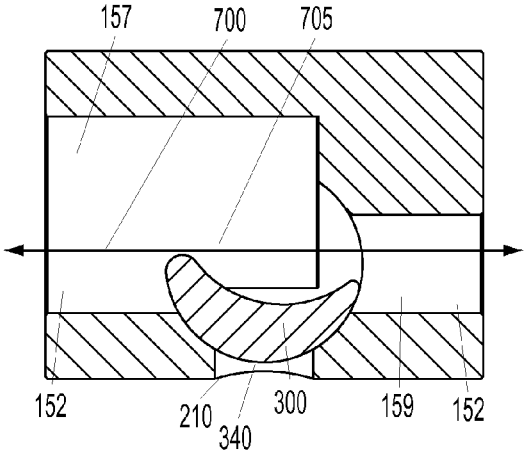
FIG. 7B1
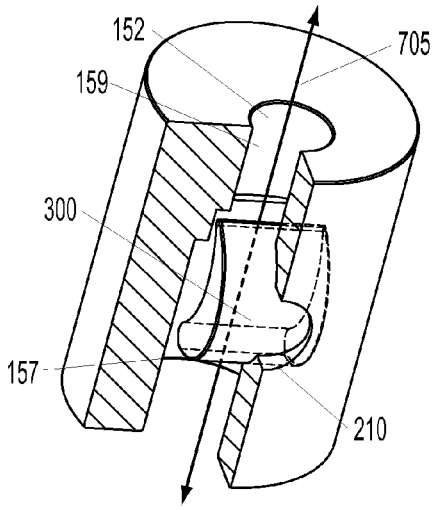
FIG. 7B2

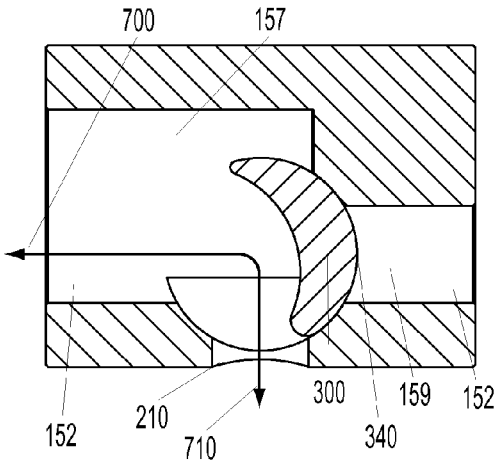
FIG. 7C1
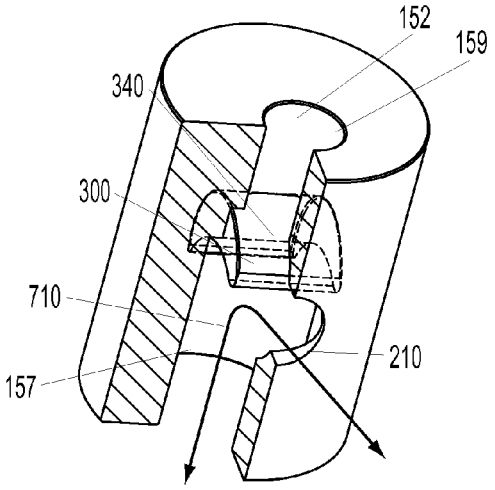
FIG. 7C2
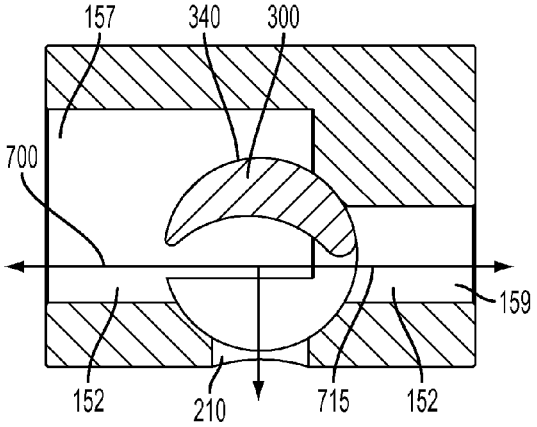
FIG. 7D1
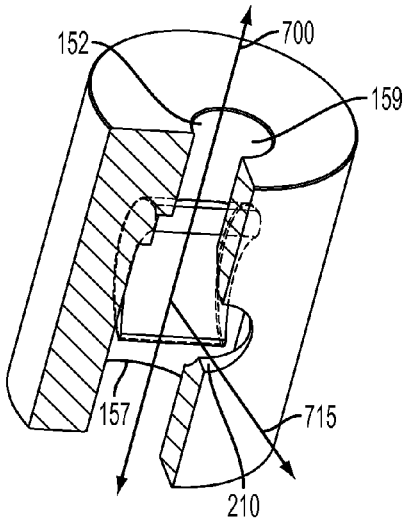
FIG. 7D2
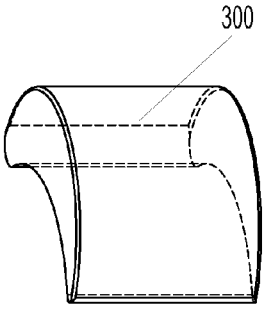
FIG. 7E

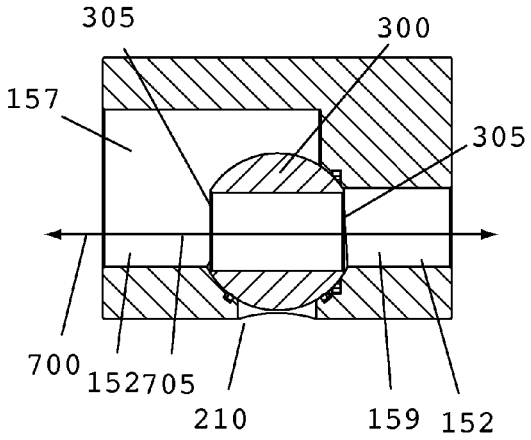
FIG. 8A1
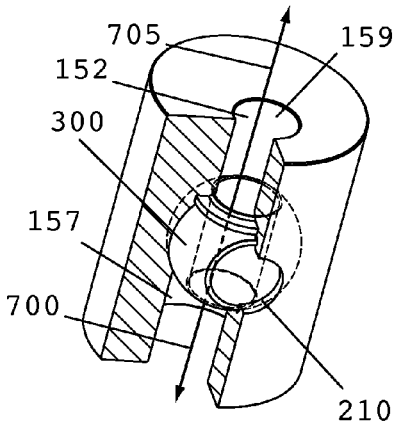
FIG. 8A2
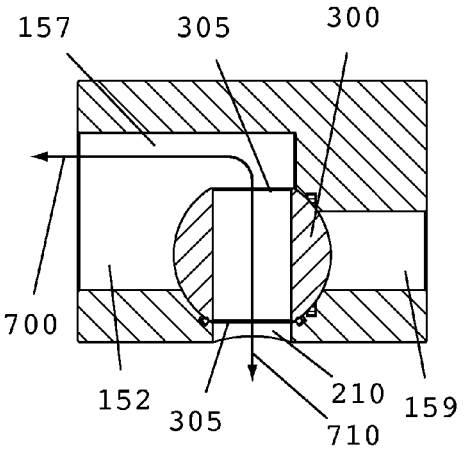
FIG. 8B1
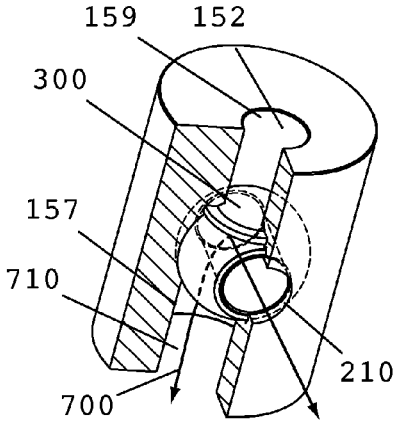
FIG. 8B2
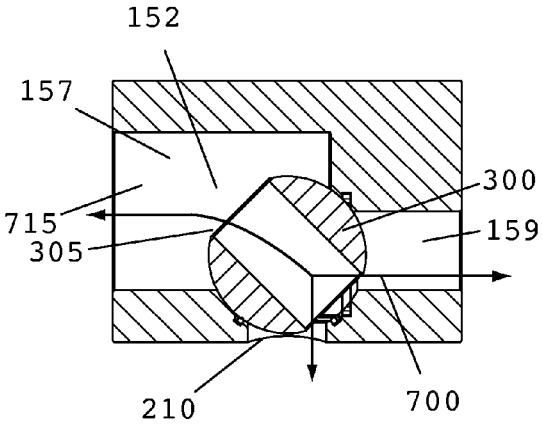
FIG. 8C1
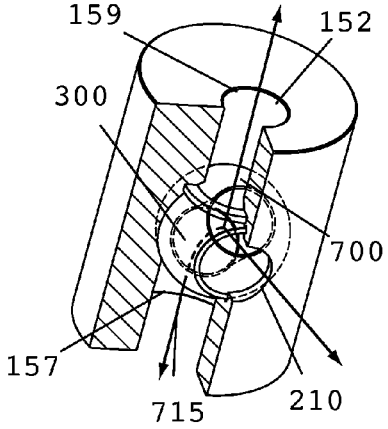
FIG. 8C2

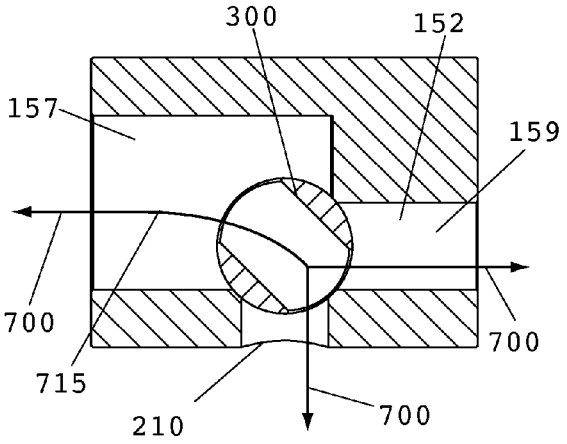
FIG. 9C1
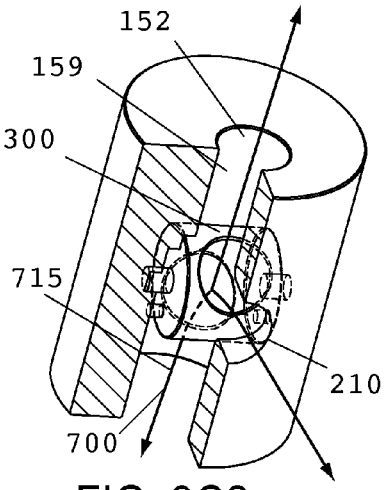
FIG. 9C2
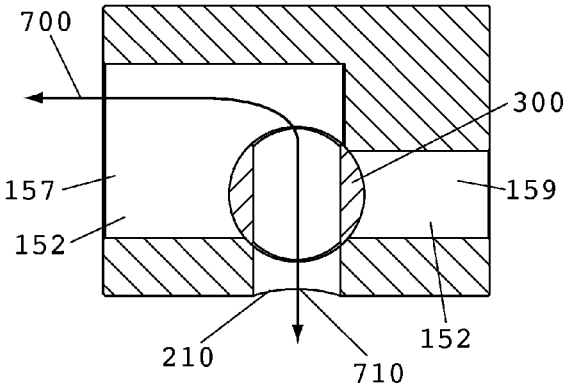
FIG. 9B1
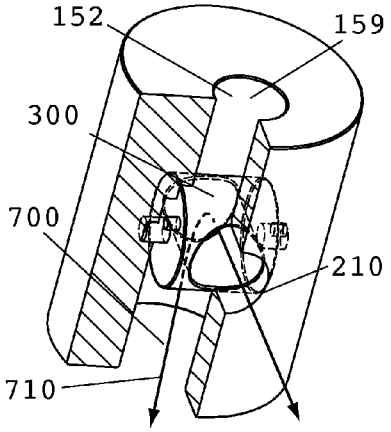
FIG. 9B2
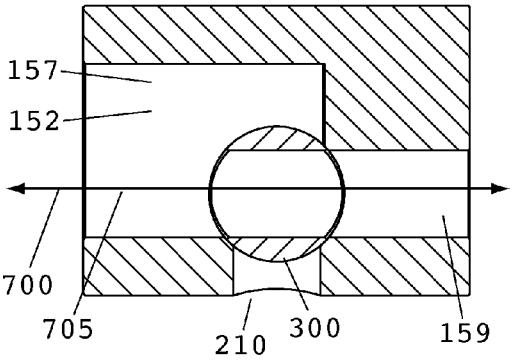
FIG. 9A1
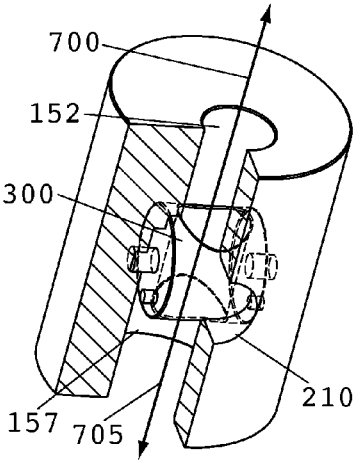
FIG. 9A2

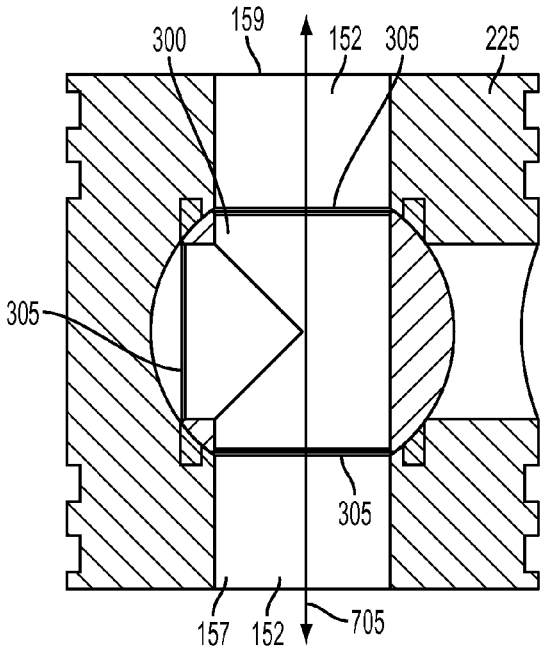
FIG. 10A1
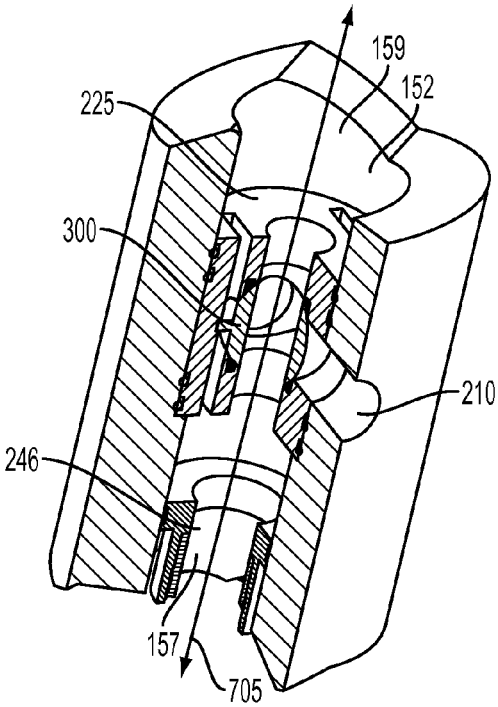
FIG. 10A2
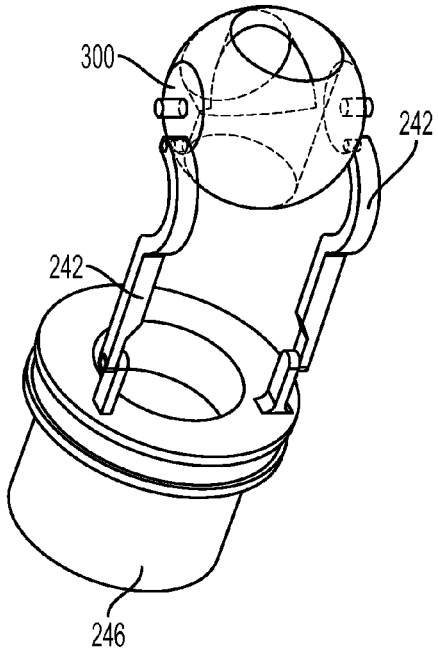
FIG. 10A3

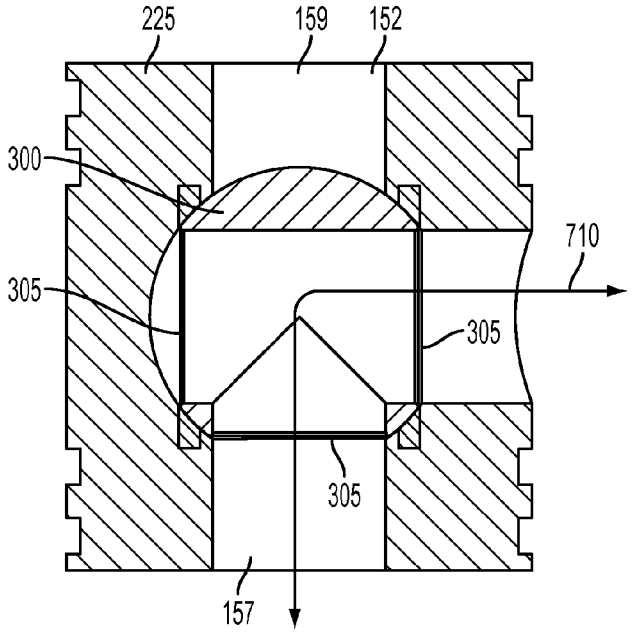
FIG. 10B1
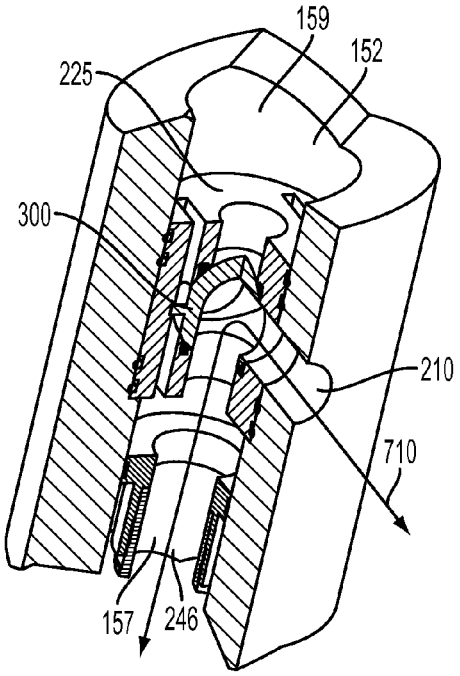
FIG. 10B2
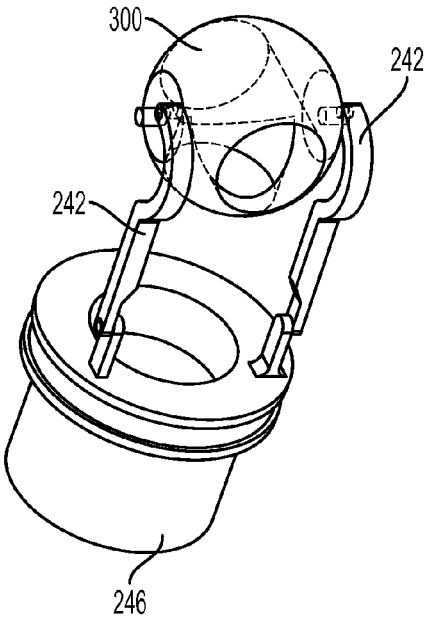
FIG. 10B3

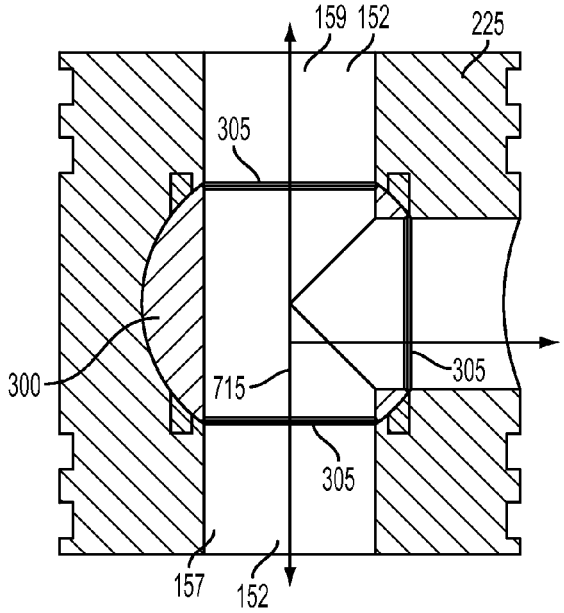
FIG. 10C1
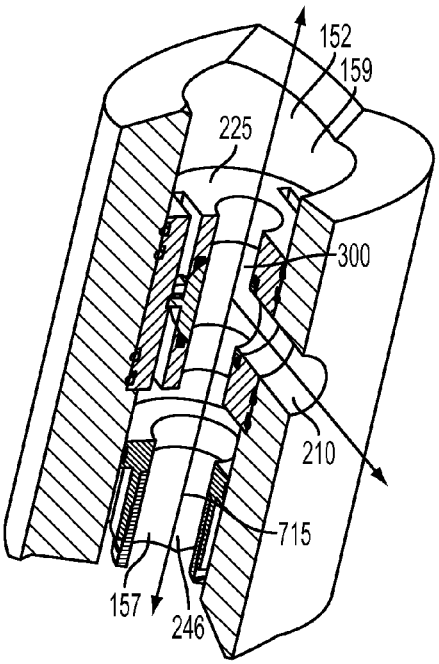
FIG. 10C2
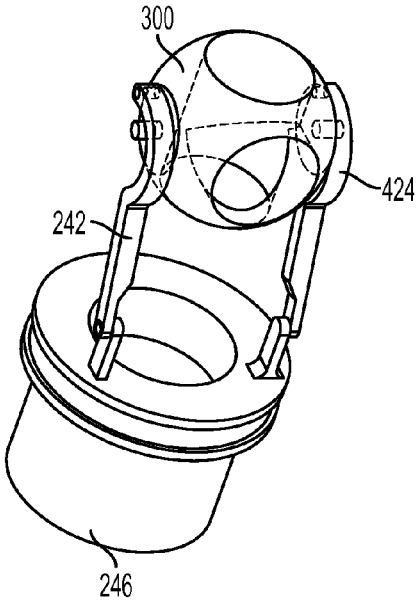
FIG. 10C3

APPARATUS AND METHOD TO REMOTELY CONTROL FLUID FLOW IN TUBULAR STRINGS AND WELLBORE ANNULUS

BACKGROUND OF THE INVENTION

1. Field of the Invention

Oil and gas drilling and completion control of fluid flow within a tubular string control of fluid flow between a tubular string inner flow passage and its annular flow passage selectively and remotely sending a command to an apparatus disposed within wellbore.

2. Description of Related Art

One aspect of the current invention is to introduce method and apparatus for selectively and remotely control fluid flow through tubular string and wellbore annulus and change fluid flow profile within wellbore, for example, divert a fraction or all of the fluid within the inner fluid flow passage to the wellbore annulus. The current invention makes it possible to control fluid flow profile and accordingly significantly reduce risks and operating cost associated with cutting beds, risks associated with fluid-losses caused by various reasons some of which were explained by way of examples, and risks associated with accumulation of suspended cuttings among other operating risks where change of fluid flow profile within the wellbore is desired. Another aspect of the current invention is to introduce a method for remotely operating a downhole apparatus selectively into a desired state without limiting operations such as flow rate or flow pressure when it is not desired to change fluid flow pattern. Different forms of solutions in existence as sighted in published patents as sighted.

One known form of flow control apparatus such as those U.S. Pat. No. 4,889,199 are operated using what is called drop ball. Another form of flow control apparatus, sometimes called bypass tool or called circulation apparatus, defines ports in the apparatus body which are initially closed by an axially movable sleeve.

One known form of flow control apparatus such as those published in U.S. Pat. No. 4,889,199 are operated using what is called drop ball. It includes a body with port which normally closed by sleeve, the sleeve also defining a bore restricting profile. When it is desired to move the sleeve to open the port, a ball is inserted into the string at the surface and pumped down the inner flow passage of the tubular string to engage the such drop ball operated apparatus often sleeve profile. Introduce limitations to the drilling practices and causing increase in operating cost. For example, the drop ball introduces restrictions within the inner flow passage and imposing limitation on running services using wireline to access, for example, to run free point services or interact with logging while drilling equipment located beneath the drop ball operated apparatus. Other downhole remotely operated apparatus such as those in sited references induce limitation in the operating practice where fluid flow properties such as flow rate or pressure has to be kept within certain levels to maintain the apparatus in the corresponding state. This limitation causes the drilling operation efficiency to suffer as it may be desirable to operate the drilling fluid for example at a different flow profile such as different flow rate or pressure that my undesirably cause the apparatus to change mode.

SUMMARY OF THE INVENTION

An apparatus for remotely and selectively control fluid flow in tubular strings and wellbore annulus, comprising: a body defining the boundaries between an inner flow passage through the apparatus and an annular flow passage within the wellbore annulus and having two suitable end connection (s) and at least one lateral hole suitable for connecting the inner flow passage and the annular flow passage;

a controllable valve operable in plurality of desired states for altering the fluid flow pattern within the wellbore wherein the valve is having at least one rotatable element wherein the rotatable element is rotatable to plurality of desired positions. The valve further divides the inner flow passage into upstream and downstream wherein the upstream is the portion of the inner flow passage between the valve and through one end connection of the body and the downstream is the portion of the inner flow passage between the valve and through the other end connection of the body;

an activator disposed within the body capable of selectively change the apparatus in either one of two modes: a disabled mode wherein the valve is not operable, and an enabled mode wherein the valve is operable to a desired state, comprising a means for detecting an intended change in the environment; and an actuator capable of changing the rotatable element position to cause the valve into a desired state comprising a means for transforming a suitably available energy source into a mechanical movement.

The rotatable element is suitably selected to cause the valve into a specific state and to cause a change of the flow pattern into one or more of the following patterns:

No flow pattern wherein the flow passage between the upstream and the downstream is restricted and the flow passage between the inner flow passage and the annular flow passage is also restricted and the valve is in no flow state;

Through flow pattern wherein the passage between the upstream and the downstream of the inner flow passage is not restricted whereas the passage between the inner flow passage and the annular flow passages is restricted and the valve is in through flow state;

Diverted flow pattern wherein the flow passage between the upstream and the annular flow passage is not restricted whereas the flow passage to the downstream is restricted and the valve is in diverted flow state; and Full flow pattern wherein the flow passage between the upstream and the downstream of the inner flow passage is not restricted and the flow passage between the inner flow passage and the annular flow passages is not restricted and the valve is in full flow state.

The rotatable element is of a specific form having at least one surface. One possible form of the rotatable element is a ball shaped rotatable element having plurality of surfaces whereas at least one surface comprises a portion of a spherical shape. The form of the rotatable element further comprises plurality of ports located on its surfaces and further comprises a plurality of cavities connecting the ports to form a plurality of flow passage through the rotatable element.

The flow control apparatus further comprises a plurality of sensor means for detecting an intended change in a physical property of the environment resulting in a signal within the apparatus suitable for processing. Such a sensor means could take the form of pressure sensor affected by pressure variation within the wellbore caused, by way of example, by a change of the flow control apparatus depth by moving the tubular string deeper into the earth or bringing the tubular string up to surface for a certain distance within the wellbore. Another means of causing the pressure to change at the pressure sensor within the flow control apparatus is through a means of changing of fluid flow pressure introduced from surface. Another form of the sensor means could be a flow sensor affected by variation of flow property such as fluid flow rate within the wellbore. Another possible form of the sensor means is an electrode for detecting an electrical signal such as a change of the potential voltage or electric current of the electrode with respect to the tubular string caused by induced electric signal into the formation.

A further other possible form of the sensor means is an accelerometer affected by a change of tubular string movement in one or more direction such as a change of the tubular string rotation speed or such as moving the tubular string within the wellbore deeper into the earth or through axial movement or other movement or any combination thereof. Another form of the sensor means is a form of magnetometer affected by magnetic field changes due to change of surrounding magnetic conductivity, or affected by change of the detected earth magnetic signal in certain pattern caused by a change of the apparatus location within wellbore for example by way of moving the tubular string.

The flow control apparatus further comprises a controller means in for processing the signal generated by the sensor means explained above. The controller means is capable of comparing the detected signal pattern to a predetermined command pattern. When a command pattern is detected, the controller means cause the specific change within the apparatus such as causing the apparatus to be in the enabled mode or to cause the apparatus to be in the disabled mode.

The flow control apparatus further comprises a locking means for restricting the change of the apparatus mode. The locking means is capable for selectively restricting the change of the valve state when it is not desired to change the same. The locking means is also suitable for enabling the change of the apparatus mode and is suitable for enabling the change of the valve state when it is desired to perform such a change as per command pattern detected or processed within the activator.

The flow control apparatus further comprises an actuator means for causing a mechanical movement of the rotatable element and accordingly causing a change in the valve state therefore causing a change in flow pattern. One possible form of the actuator means is a form of electric motor powered by a battery, a generator, a charged capacitor or other suitable electric energy source disposed within the apparatus or available on a different location within the tubular string or on surface connected to the apparatus by a connecting means such as wireline cable introduced form surface to the apparatus through the wellbore.

Another possible form of the actuator energy source is an energized resilient element such as a compressed spring. The resilient element stores energy when caused to change its state from relaxed state to a stressed state alternatively called an energized state by means of compressing the resilient element from its relaxed state or by means of coiling or stretching the resilient element from original relaxes state. The resilient element in such a stressed mode when connected to the rotatable element could cause it into a different state particularly when the flow control apparatus is in enabled mode. Another form of the energized resilient element is a form of compressed spring disposed within the flow control apparatus before disposing the flow control apparatus into the wellbore.

A further possible form of an energized resilient element is a spring that is caused to be stressed, by way of example, in a form of compression while within the wellbore by another energy source such as the hydraulic energy harvested from fluid flow within the wellbore. The energized resilient element is capable of releasing mechanical energy when it is made possible to move from stressed position to a relaxed position. Another possible form of the actuator transforming a mechanical energy source caused by an inertia mass element disposed within the flow control apparatus. When the flow control apparatus is in the enabled mode, the inertia mass element is energized by way of momentum or inertia through movement of tubular string, and is possible to cause a change of the valve state when connected to the rotatable element.

Another form of energy transformation caused by the actuator is to transform a hydraulic energy means of the fluid flowing through the inner flow passage or annular flow passage or any combination thereof to generate a mechanical energy causing the rotatable element to change position.

A possible embodiment of the actuator element transforming hydraulic energy from fluid flowing through the wellbore is an orifice disposed within the inner flow passage that is stressed to a level or pushed against a resilient element in certain direction when the fluid flow through the inner flow passage. It is understood that the energy sources explained herein are made by way of example and not exhaustive. The same function could be achieved by other means of energy sources suitably available within the apparatus caused to be utilized or harvested when it is desired to change the position of the rotatable element or when it is desired to change the state of the valve or when it is desired to change the mode of the apparatus or when it is desired to change the fluid flow pattern within the wellbore.

BRIEF DESCRIPTION OF THE DRAWINGS

A complete understanding of the present invention may be obtained by reference to the accompanying drawings, when considered in conjunction with the subsequent, detailed description, in which:

FIG. 7 is a detail view of an example of a possible flow passage caused by having a form of a rotatable element disposed in different possible position within the valve body wherein the rotatable element comprising a curved outer surface;

FIG. 8 is a detail view of an example of a possible flow passage caused by having a form of a rotatable element disposed in different possible positions within the valve body wherein the rotatable element is a form of a two ports rotatable element comprising a spherical surface and having two ports and one cavity connecting the two ports;

FIG. 9 is a detail view of an example of a possible flow passage caused by having a form of a rotatable element disposed in different possible position within the valve body wherein the rotatable element is a form of a cylindrical shaped rotatable element having two ports and one cavity connecting the two ports;

FIG. 10 is a detail view of an example of a possible flow passage caused by having a form of a rotatable element disposed in different possible position within the valve body wherein the rotatable element is a form of a three ports rotatable element comprising a spherical surface and having three ports and one cavity connecting the three ports;

For purposes of clarity and brevity, like elements and components will bear the same designations and numbering throughout the Figures.

DESCRIPTION OF THE PREFERRED EMBODIMENT

Figure 1:
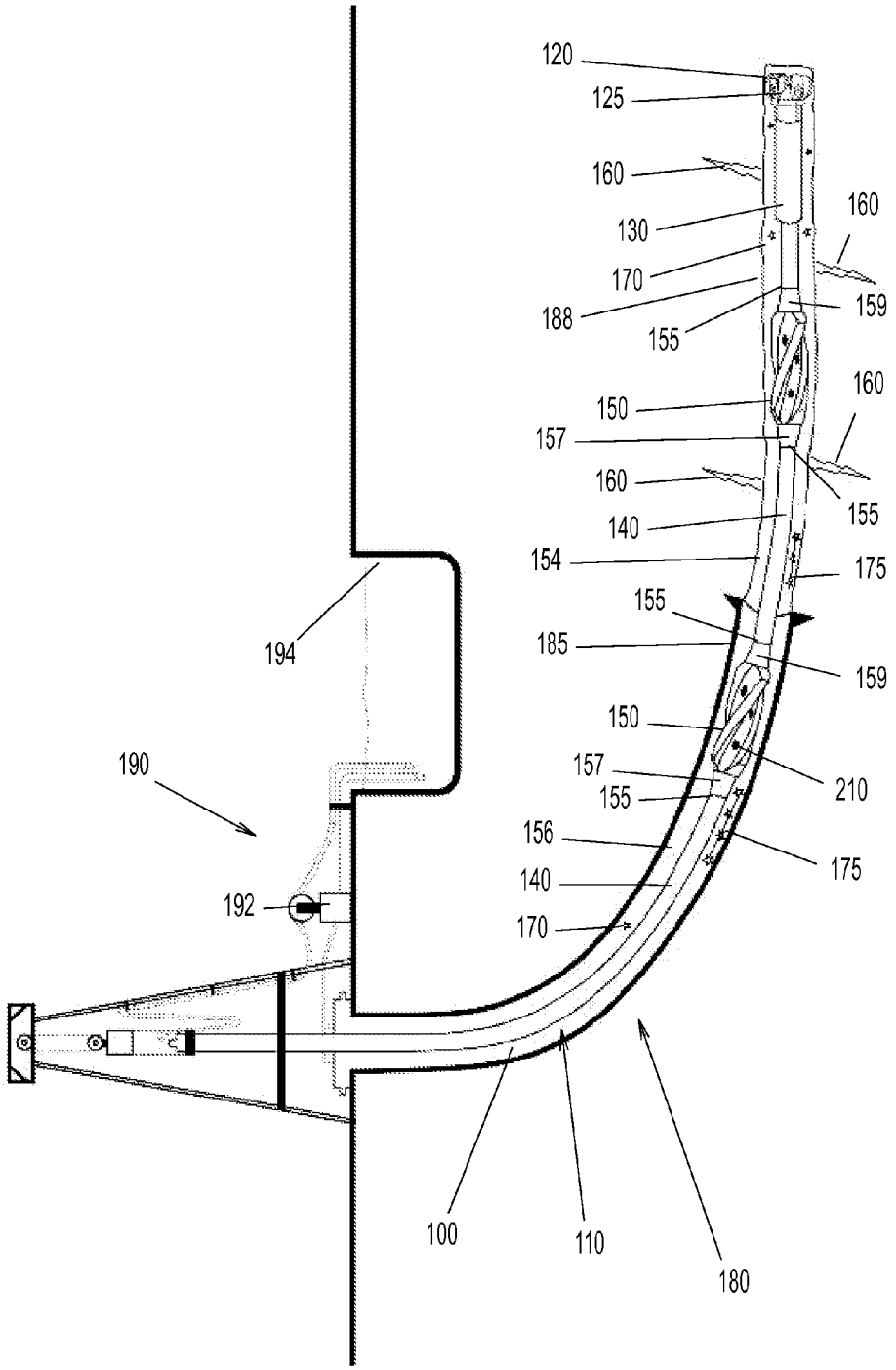
FIG. 1 is a section view of a possible embodiment of a wellbore drilling system wherein a plurality of the fluid flow control apparatus are disposed within drilling tubular string.

FIG. 1 is a section view of a possible embodiment of a wellbore 100 drilling system wherein a plurality of the fluid flow control apparatus 150 are disposed within drilling tubular string 110 during well forming operation. Majority of drilling systems used in current days include a tubular string 110 composed of a drill bit 120 having a plurality of perforations 125 located through the drill bit 120 to allow fluid flow there through. A heavy tubular with bigger outer diameter among other equipment such as mud motors or logging while drilling equipment or directional drilling control systems, or any combination thereof that is frequently called bottom hole assembly 130 connected to the drill bit 120 from one end. Bottom hole assembly 130 is normally connected by form of thread from the other end to other tubular conduit such as drill pipe 140 connecting the bottom hole assembly 130 to surface. The drill pipe 140 outer diameter is commonly known to be smaller when compared to the bottom hole assembly 130, therefore the annular volume surrounding the drill pipe 140 within the wellbore 100 over any particular length is larger than the annular volume surrounding the bottom hole assembly 130 of equivalent length within the wellbore 100. Plurality of fluid flow control apparatus 150 disposed within the wellbore 100 are connected to a portion of the tubular string 110 by a suitable means normally a form of thread on each end connection 155 of the flow control apparatus 150. The wellbore 100 formed into the earth may have a deviated section 180 where the wellbore 100 is not vertical. A cased hole 185 section is the portion of the wellbore 100 having a tubular of large diameter called casing lining the inner side of the wellbore 100 to protect wellbore 100 from damage. While drilling a deeper section into earth formations an open hole 188 section of the wellbore 100 is formed. A surface mud pumping system 190 is disposed with most drilling operations and includes a drilling fluid tank 194 to store drilling fluid and a pump 192 to force fluid into the inner flow passage 152 defined as the inner space within the tubular string 110. Cuttings 170 generated from hole making are carried out through the annular flow passage 154.

An annular flow passage 154 is defined as the space between the inner wall of the wellbore 100 and the outer wall of the tubular string 110. Cutting beds 175 are sometimes formed by accumulation of cuttings 170 deposited normally at the lower side of wellbore 100 particularly in deviated section 180 of open hole 188 or cased hole 185 of wellbore 100. Plurality of fractures 160 connected to wellbore 100 may naturally exist or formed during the drilling operations. When fractures 160 exist in a wellbore 100, they may act as a passage causing a portion of drilling fluid to flow into earth formation causing what is commonly known as losses. When losses are encountered, well control is compromised and drilling operation risks and costs are increased. The flow control apparatus 150 comprises a valve 220. The valve 220 further divides the inner flow passage 152 into upstream 157 section and downstream 159 section where upstream 157 section is defined as the portion of the inner flow passage 152 from the valve 220 and through the upstream 157 end connection 155 of the flow control apparatus 150 and the downstream 159 section as defined as the portion of the inner flow passage 152 from the valve 220 and through the downstream 159 end connection 155 of the flow control apparatus 150.

Figure 2:
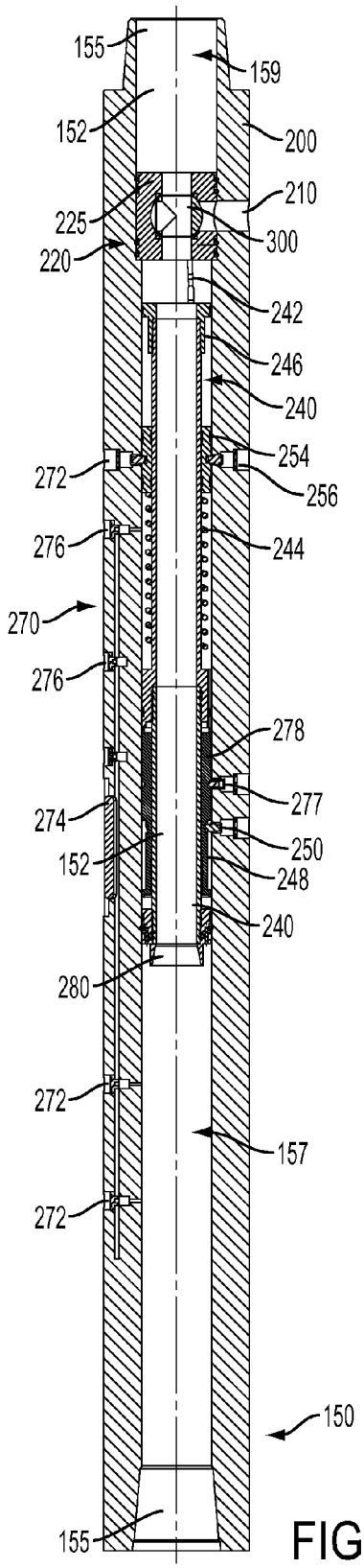
FIG. 2 is a section view of a preferred embodiment of the flow control apparatus.
Figure 3A:
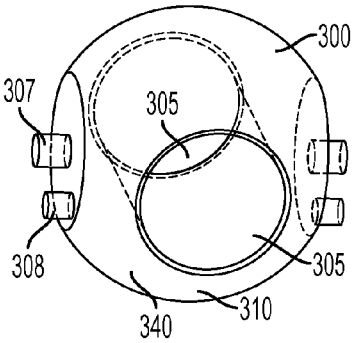
FIG. 3 is a detail view of a possible embodiment of rotatable element by way of example.
Figure 3B:
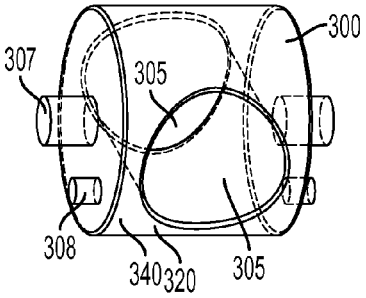
Figure 3C:
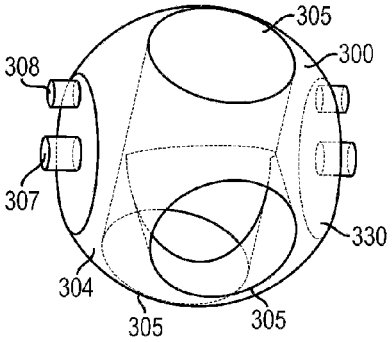
Figure 3D:
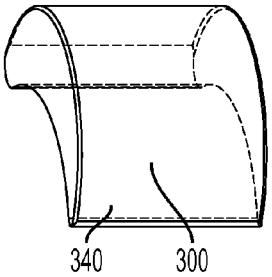

FIG. 2 is a section view of a preferred embodiment of the fluid flow control apparatus 150 comprising a body 200 defining the boundaries between an inner flow passage 152 through the apparatus and the annular flow passage 154 within the wellbore annulus 156 and having a suitable connecting means such as a form of thread to connect the apparatus body 200 to a portion of the tubular string 110 through an end connection 155 disposed on each end connection 155 of the body 200. One of the end connections is the upstream 157 end connection 155, and the other end connection 155 is the downstream 159 end connection 155. The body 200 further comprises one or more lateral hole 210 suitable for connecting the inner flow passage 152 to the annular flow passage 154. The flow control apparatus 150 further comprises a valve 220. The valve 220 is the element of the flow control apparatus 150 which allows or restricts the flow connectivity between the upstream 157 section, the downstream 159 section, the inner flow passage 152 and the lateral hole 210 connecting to the annular flow passage 154. The valve 220 is composed of a valve housing 225 and a plurality of rotatable elements. The valve housing 225 could be an integral part of the body 200 or a separate element inserted into the body 200 inner space. The rotatable element 300 is suitable to be rotated into a plurality of positions. Each position taken by the rotatable element 300 causes the valve 220 to be in a state suitable to connect the flow passages to establish a particular flow pattern within the flow control apparatus 150, hence wellbore 100 as will be explained later when describing FIGS. 7, 8, 9 and 10.

The flow control apparatus 150 further comprises an actuator 240 capable of transforming a suitably available energy into a mechanical energy suitable for rotating the rotatable element 300 into a desired position. By way of example, the actuator 240 in this figure is composed of an actuation mandrel 246 disposed within the body 200 and movable with respect to the body 200. The actuation mandrel 246 is having an inner surface that is forming part of the inner flow passage 152 and is having a flow orifice 280 profile suitable to be affected by the fluid flowing through the inner flow passage 152. When a fluid flows through the actuation mandrel 246 the hydraulic energy from the fluid flow exerts a suitable force on the flow orifice 280 causing the actuation mandrel 246 to move with respect to the body 200 and exert a suitable force on the actuation linkage 242 suitably attached to the rotatable element 300 push-pull point 308 causing the rotatable element 300 to rotate and change its position. The actuation mandrel 246 is suitably attached to a resilient element such as a spring 244. When the actuation mandrel 246 moves by effect of hydraulic energy from fluid flow, it pushes the resilient element in a suitable direction that causes it to deform and build strain energy which is stored within the resilient element. When the resilient element is allowed to relax and deform back to the previous shape, it will release the stored strain energy into a mechanical movement that is suitable for the actuation mandrel 246 to utilize in order to perform the desired actuation. The above is a demonstration of the actuator 240 causing a transformation of hydraulic energy from fluid flowing through the wellbore 100 inner flow passage 152 to a mechanical energy in the form of actuation mandrel 246 movement. The above is a further demonstration of the actuator 240 causing a transformation of mechanical energy originating from actuation mandrel 246 movement into another form of energy such as strain energy stored within a suitable resilient element located within the apparatus. The spring 244 form of the resilient element is held on the other end by a spring retainer 254 suitably maintained in its position by a suitable fastener such as a spring retainer bolt 256 connecting the spring retainer 254 to the body 200. The spring 244 form of a resilient element is located within the apparatus to keep the actuation mandrel 246 biased in certain direction. The flow control apparatus 150 further comprises an activator 270. The activator 270 includes a means of detecting a physical change in the environment using one or more sensor 272 disposed within the apparatus. The sensor 272 is capable of being affected by intended change in one or more physical property of the environment caused by action initiated on surface by the operator.

The activator 270 further comprises a locking means to put the flow control apparatus 150 into either enabled mode or disabled mode. In the enabled mode, the actuator 240 within the flow control apparatus 150 will be operable, whereas in the disabled mode, the actuator 240 within the flow control apparatus 150 is inoperable. By way of example, the locking means comprises a lock 277 element such that when engaged with a suitable locking groove 278 suitably connected to the actuation mandrel 246, it will restrict the movement of one or more of the actuator 240 elements such as the actuation mandrel 246 and cause the flow control apparatus 150 to be in a disabled mode. When the apparatus is in disabled mode, the valve 220 is not operable to change its state. When the lock 277 is disengaged from the locking groove 278, the actuator 240 disposed within the flow control apparatus 150 will not be restricted by the lock 277 element and the flow control apparatus 150 will be in enabled mode and the valve 220 will be operable into a different state.

The activator 270 further comprises a controller 274 suitable to analyze the signal output of the sensor 272 and compare it to a command pattern 899 to determine the desired mode then cause suitable changes within the activator 270. The controller 274 comprises a movement limiting means to limit the actuation linkage 242 movement and cause it to stop after a desired displacement. By a way of example, the movement limiting means of movement control comprises a barrel cam 248 disposed within the body 200 and suitably connected to the actuation mandrel 246. The barrel cam 248 comprises a cam track 740 with a profile suitable for a cam follower 250 disposed within the body 200 to limit the movement of the barrel cam 248 travel between specific predetermined two or more track point such as those explained in FIG. 13. Any of the track point restricts the barrel cam 248 displacement from movement in one or more direction. As the barrel cam 248 is suitably connected to the actuation mandrel 246, when the flow control apparatus 150 is in enabled mode, the movement of the barrel cam 248 as determined by the cam follower 250 travelling the cam track 740 causes the actuation mandrel 246 movement to be restricted between specific desired positions.

FIG. 3 is a detail view of possible embodiments of the rotatable element 300. Detail A is a view of a two ports rotatable element 310 having at least one spherically formed surface and having one port 305 on its surface and another port 305 on its surface wherein both ports are suitably connected through a cavity within the rotatable element 300. Detail B is a view of a cylindrical rotatable element 320 having at least one surface curved in a cylindrical form, and having one port 305 on its surface and another port 305 on its surface wherein both ports are suitably connected through a cavity within the rotatable element 300. Detail C is a view of a three ports rotatable element 330 having at least one form of a spherical surface and having at least three ports on its surfaces wherein each port 305 is suitably connected to another port 305 through a cavity within the rotatable element 300. Detail D is a view of a general form of a possible embodiment of a rotatable element 300 having at least one outer surface 340 suitable to engage with one or more fluid flow passage such as the inner flow passage 152, upstream 157 section, downstream 159 section and a lateral hole 210 connecting to the annular flow passage 154.

Figure 4:
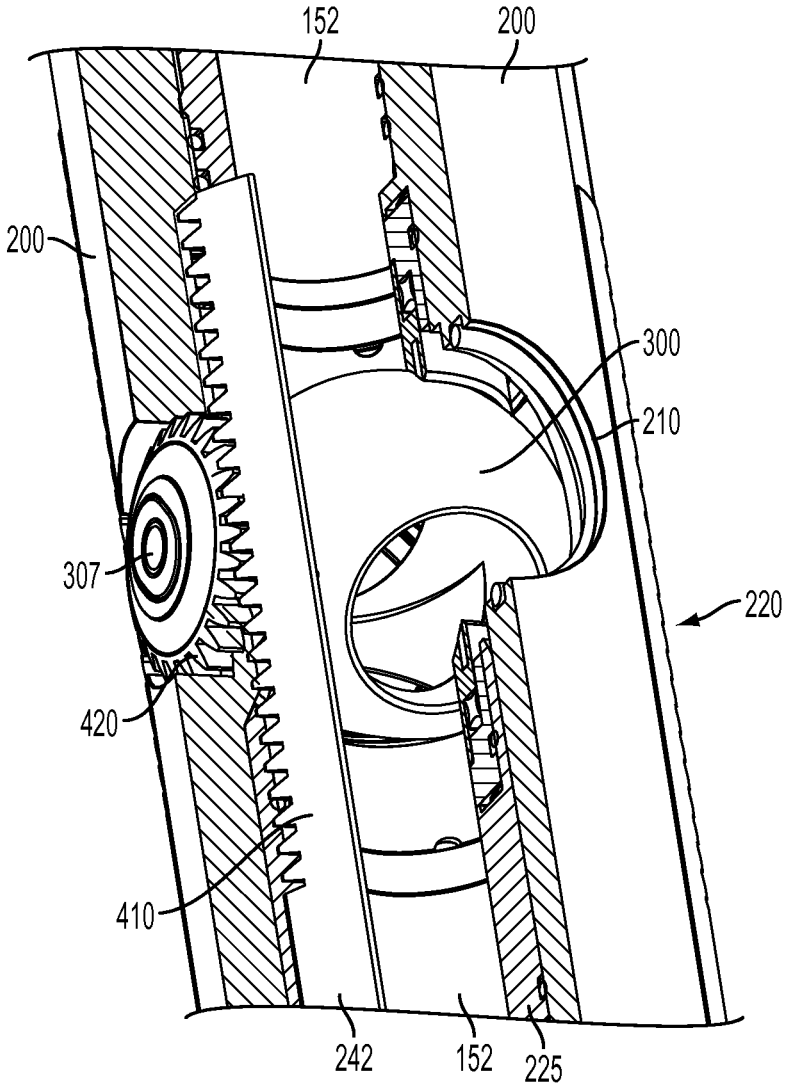
FIG. 4 is a perspective cutaway view of a possible embodiment of the actuator in a form of rack and pinion.

FIG. 4 is a prospective cutaway view of a possible embodiment of actuation linkage 242 causing the rotatable element 300 to change position using what is known in the art as rack 410 and pinion 420, where at least one pinion 420 is suitably connected to the rotatable element 300 and at least one rack 410 is connected to the actuation mandrel 246 and both the rack 410 and the pinion 420 are suitably engaged so that when the rack 410 moves in certain direction the pinion 420 rotates around a suitably located pivot 307. Engagement between rack 410 and pinion 420 is commonly formed by way of a matching thread however other forms are also possible, such as by way of example, a friction surface or a magnetic coupling. In this figure the valve 220 is composed of a valve housing 225 located inside the body 200 and the rotatable element 300 is in the form of three ports rotatable element 330 explained earlier.

Figure 5:
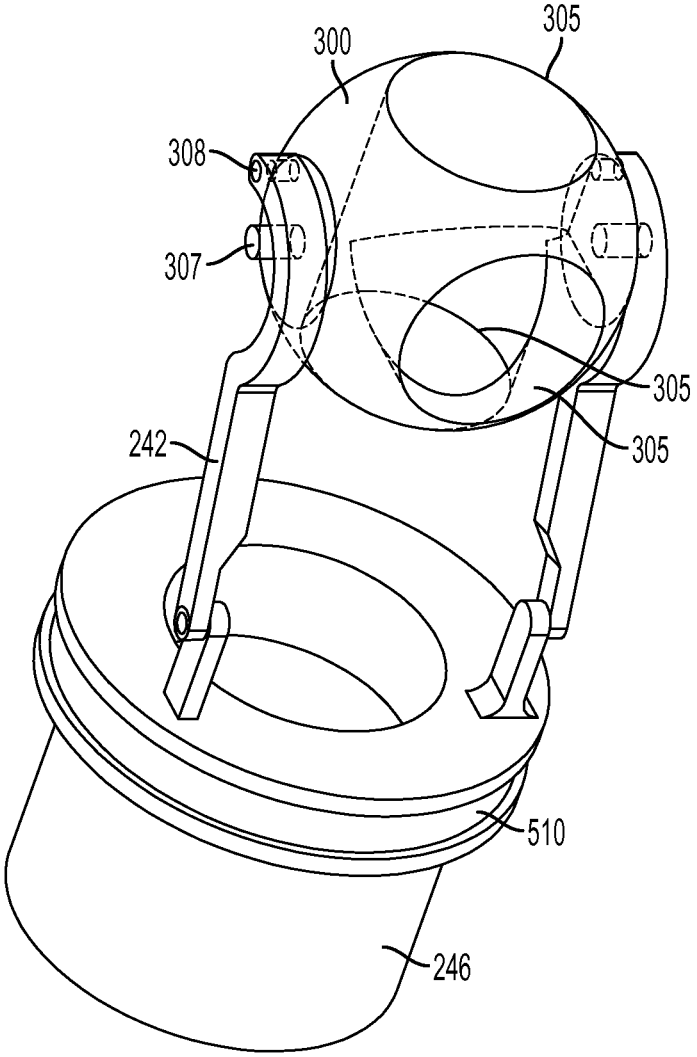
FIG. 5 is a detail view of a possible embodiment of the actuator linkage and mechanical energy source.

FIG. 5 is a detailed view of another possible embodiment of actuation linkage 242 suitable to cause rotatable element 300 to change position. In this figure movement of the actuation mandrel 246 in a suitable direction cause the actuation linkage 242 to exert a suitable force on the push-pull point 308 causing the rotatable element 300 to change position. An inertia element 510 is disposed within the actuation mandrel 246 having a suitable mass capable of storing kinetic energy in proportion to its mass and speed of movement. When the tubular string 110 moves in certain direction such as when moved along the wellbore 100 axis by pulling in the direction out of wellbore 100 to earth surface or lowering it deeper into earth through the wellbore 100, the flow control apparatus 150 follow the same movement as it is rigidly connected at its end connection 155 through a form of thread to a portion of the tubular string 110 and causing elements disposed within the flow control apparatus 150 to follow the same movement as the tubular string 110. A possible embodiment energy source disposed within the actuator 240 having a means of transforming mechanical energy from tubular string 110 movement within the wellbore 100 into mechanical energy capable of operating the valve 220 is explained hereafter. An inertia element 510 disposed within the actuation mandrel 246 having a suitable mass explained in FIG. 5 is referred to. When the tubular string 110 moves in certain direction such as along the wellbore 100 axis by pulling it out of wellbore 100 or lowering it deeper into earth through the wellbore 100, the flow control apparatus 150 follow the same movement as it is rigidly connected at its ends through a form of thread to a portion of the tubular string 110 and causing elements disposed within the flow control apparatus 150 to follow the same movement as the tubular string 110 the inertia element 510 will store kinetic energy in proportion to its mass and to its movement speed and accordingly to the movement speed of the tubular string 110. When tubular string 110 movement changes, the inertia element 510 will lag the change of movement in time before it follows the new movement of the tubular string 110 due to its stored kinetic energy. When the flow control apparatus 150 is in enabled mode, the change of energy stored in inertia element 510 due to change in tubular string 110 movement can cause movement of the actuation mandrel 246 in a suitable direction causing the rotatable element 300 to change position.

By way of example, in the case when the tubular string 110 is lowered into earth formation then stops, a change of movement occurs. The kinetic energy stored within the inertia element 510 will cause it to continue movement in the original direction if the flow control apparatus 150 is in enabled mode that could be transformed into a mechanical movement to cause the change of rotatable element 300 position.

Figure 6:
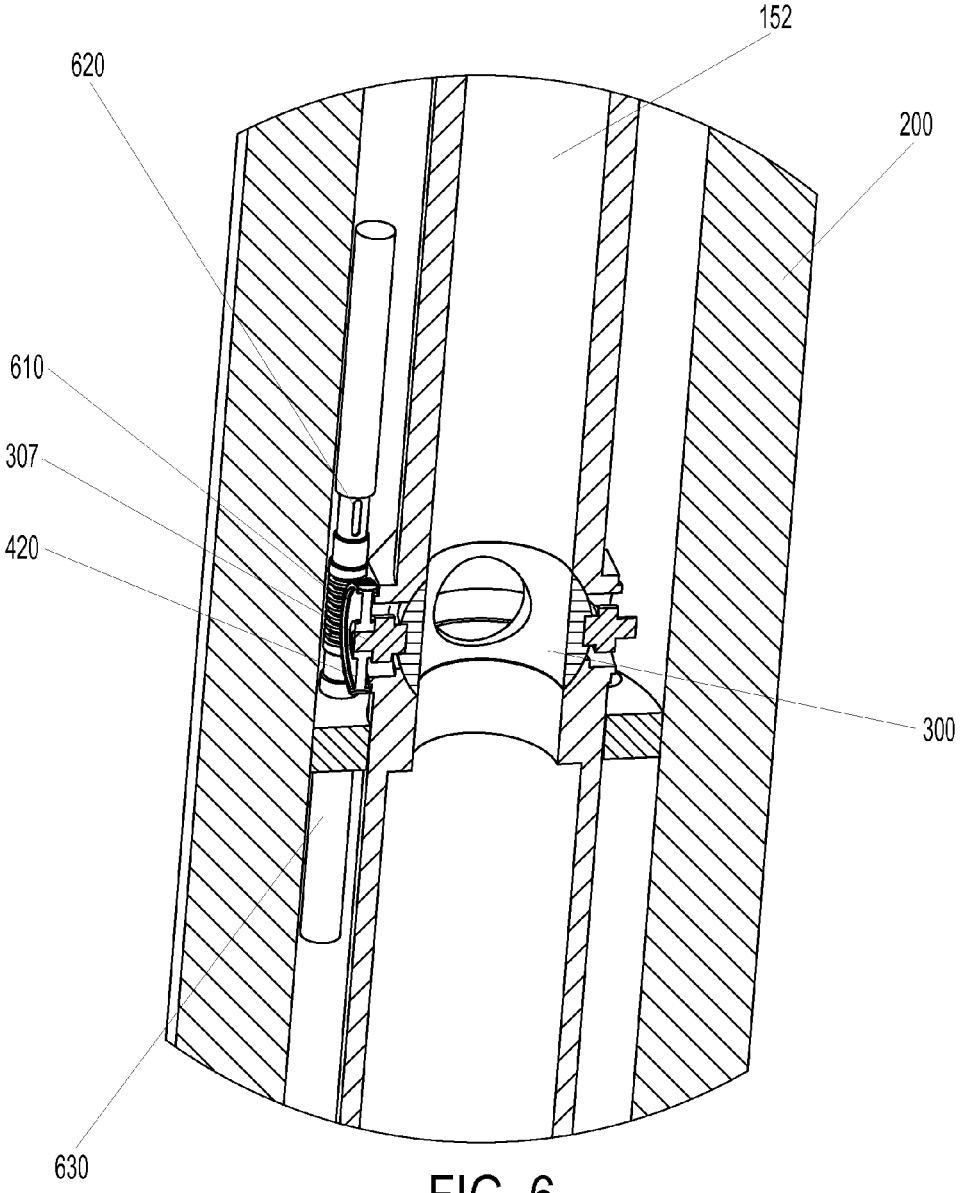
FIG. 6 is a section view of a possible embodiment of actuator and energy source disposed within the flow control apparatus body.

FIG. 6 is a section view of a possible embodiment of actuator 240 having an electric motor 620 means of transforming a suitably available electrical energy source into a mechanical energy capable of changing the position of the rotatable element 300 by means of linkage in the form of a suitable gear engagement such as worm gear 610 and pinion 420. When the suitable electric energy source is connected to the electric motor 620 causing the worm gear 610 connected to the electric motor 620 output to adequately rotate the pinion 420 that is suitably connected to the rotatable element 300 around the pivot 307 and as a result changing the rotatable element 300 position.

In this figure an alternative energy source disposed within the apparatus in a form of energized resilient element means of mechanical energy source disposed within the apparatus. An energized spring 630 by way of example such as a strained coiled spring 244 or other form of resilient element strained is suitably connected to the pinion 420 by means of a suitable linkage such as a worm gear 610. When the flow control apparatus 150 is enabled, stored mechanical energy disposed within the energized spring 630 is allowed to relax to a less strain state by releasing strain energy into mechanical movement causing the worm gear 610 to adequately move the pinion 420 that is suitably connected to the rotatable element 300 around the pivot 307 and as a result changing the rotatable element 300 position. The example explained above of strain energy stored in a resilient element is similar to the energy stored in a watch winding spring 244 explained in sighted U.S. Pat. No. 163,161 filed in 1874. A means of transforming mechanical energy source disposed within the apparatus in a form of and energized resilient element is explained. The electric motor 620 is suitable for transforming an electrical energy from a suitable electrical energy source disposed within the flow control apparatus 150 in a form of suitable battery 276 or an electric generator. Eclectic generator could be in the form of turbine transforming hydraulic fluid flowing through the wellbore 100 into electrical power source that could be used directly or stored in a form of electrical storage such as rechargeable battery 276 or a capacitor. In a different embodiment the electrical energy source could be disposed within the tubular string 110 or in the bottom hole assembly 130. In another embodiment the electrical energy source could be on surface in a form of battery 276 or electric line from domestic energy source or from drilling system generator. Those electrical energy sources not disposed within the flow control apparatus 150 could be connected to the apparatus actuator 240 by a connecting means such as wireline cable commonly used for wireline services in the oil well making by companies such as Schlumberger or Halliburton, and other electric wireline service providers.

FIG. 7 is a detailed view of possible embodiment of the valve 220 presented in different states by way of presenting the rotatable element 300 in different positions. The valve 220 is capable of forming one of more possible flow passage 700. Detail (AI) is a section view and detail (A2) is a prospective cutaway view of the valve 220 in one state where the rotatable element 300 is in a position such that it restricts flow passage between the inner flow passage 152 and the annular flow passage 154 by way of aligning the outer surface 340 to obstruct flow passage between the inner flow passage 152 and the lateral hole 210. The rotatable element 300 in this position further restrict flow passage within the inner flow passage 152 between the upstream 157 section and downstream 159 section passages by way of aligning the outer surface 340 to obstruct the inner flow passage 152 between the upstream 157 section and downstream 159 section. This figure demonstrate the no flow pattern wherein the flow passage between the upstream 157 section and the downstream 159 section is restricted and the flow passage between the inner flow passage 152 and the annular flow passage 154 is also restricted.

Detail (B1) is a section view and detail (B2) is a prospective cutaway view of the valve 220 in one state where the rotatable element 300 is in a position such that it restricts flow passage between the inner flow passage 152 and the annular flow passage 154 by way of aligning the outer surface 340 to obstruct the flow passage between the inner flow passage 152 and the lateral hole 210. The rotatable element 300 in this position does not restrict flow passage within the inner flow passage 152 between the upstream 157 section and downstream 159 section by way of aligning the outer surface 340 such that the inner flow passage 152 between the upstream 157 section and downstream 159 section is not obstructed. This figure demonstrate the through flow pattern 705 wherein the passage between the upstream 157 section and the downstream 159 section of the inner flow passage 152 is not restricted whereas the passage between the inner flow passage 152 and the annular flow passages is restricted.

Detail (C1) is a section view and detail (C2) is a prospective cutaway view of the valve 220 in one state where the rotatable element 300 is in a position such that one portion of the inner flow passage 152 is connected with the annular flow passage 154 by way of aligning the outer surface 340 such that it does not obstruct flow passage between one portion of the inner flow passage 152 and the annular flow passage 154 through the lateral hole 210. The rotatable element 300 in this position further restrict flow passage within the inner flow passage 152 between the upstream 157 section and downstream 159 section passages by way of aligning the outer surface 340 such that the inner flow passage 152 between the upstream 157 section and downstream 159 section is obstructed. This figure demonstrate the diverted flow pattern 710 wherein the flow passage between the upstream 157 section and the annular flow passage 154 is not restricted whereas the flow passage to the downstream 159 section is restricted.

Detail (D1) is a section view and detail (D2) is a prospective cutaway view of the valve 220 in one state where the rotatable element 300 is in a position such that the inner flow passage 152 is connected with the annular flow passage 154 through the lateral hole 210 by way of aligning the rotatable element 300 outer surface 340 such that it does not obstruct flow passage between the inner flow passage 152 and the lateral hole 210. The rotatable element 300 in this position further does not restrict flow passage within the inner flow passage 152 between the upstream 157 section and downstream 159 section by way of aligning the outer surface 340 such that the inner flow passage 152 between the upstream 157 section and downstream 159 section is not obstructed. This figure demonstrate the full flow pattern 715 wherein the flow passage between the upstream 157 section and the downstream 159 section of the inner flow passage 152 is not restricted and the flow passage between the inner flow passage 152 and the annular flow passages is also not restricted.

FIG. 8 is a detailed view of a possible embodiment of the valve 220 presented in different states by way of showing the rotatable element 300 in different positions. In this figure, the rotatable element 300 is in the form of two ports rotatable element 310. Detail (AI) is a section view and detail (A2) is a prospective cutaway view of the valve 220 in one state where the rotatable element 300 is in a position such that it restricts flow passage between the inner flow passage 152 and the annular flow passage 154 by way of aligning the outer surface 340 to obstruct the flow passage between the inner flow passage 152 and the lateral hole 210. The rotatable element 300 in this position does not restrict flow passage within the inner flow passage 152 between the upstream 157 section and downstream 159 section by way of aligning the outer surface 340 such that the inner flow passage 152 between the upstream 157 section and downstream 159 section is not obstructed. This figure demonstrate the through flow pattern 705 wherein the passage between the upstream 157 section and the downstream 159 section of the inner flow passage 152 is not restricted whereas the passage between the inner flow passage 152 and the annular flow passages is restricted.

Detail (B1) is a section view and detail (B2) is a prospective cutaway view of the valve 220 in one state where the rotatable element 300 is in a position such that one portion of the inner flow passage 152 is connected with the annular flow passage 154 by way of aligning the outer surface 340 such that it does not obstruct flow passage between one portion of the inner flow passage 152 and the annular flow passage 154 through the lateral hole 210. The rotatable element 300 in this position further restrict flow passage within the inner flow passage 152 between the upstream 157 section and downstream 159 section passages by way of aligning the outer surface 340 to such that the inner flow passage 152 between the upstream 157 section and downstream 159 section is obstructed. This figure demonstrate the diverted flow pattern 710 wherein the flow passage between the upstream 157 section and the annular flow passage 154 is not restricted whereas the flow passage to the downstream 159 section is restricted.

Detail (C1) is a section view and detail (C2) is a prospective cutaway view of the valve 220 in one state where the rotatable element 300 is in a position such that the inner flow passage 152 is connected with the annular flow passage 154 through the lateral hole 210 by way of aligning the rotatable element 300 outer surface 340 such that it does not obstruct flow passage between the inner flow passage 152 and the lateral hole 210. The rotatable element 300 in this position further does not restrict flow passage within the inner flow passage 152 between the upstream 157 section and downstream 159 section passages by way of aligning the outer surface 340 such that the inner flow passage 152 between the upstream 157 section and downstream 159 section is not obstructed. This figure demonstrate the full flow pattern 715 wherein the flow passage between the upstream 157 section and the downstream 159 section of the inner flow passage 152 is not restricted and the flow passage between the inner flow passage 152 and the annular flow passages is not restricted.

FIG. 9 is a detailed view of possible embodiment of the valve 220 presented in different states by way of showing the rotatable element 300 in different positions. In this figure, the rotatable element 300 is in the form of a cylindrical shaped rotatable element 300. Detail (AI) is a section view and detail (A2) is a prospective cutaway view of the valve 220 in one state where the rotatable element 300 is in a position such that it restricts flow passage between the inner flow passage 152 and the annular flow passage 154 by way of aligning the outer surface 340 to obstruct the flow passage between the inner flow passage 152 and the lateral hole 210. The rotatable element 300 in this position does not restrict flow passage within the inner flow passage 152 between the upstream 157 section and downstream 159 section by way of aligning the outer surface 340 such that the inner flow passage 152 between the upstream 157 section and downstream 159 section is not obstructed. This figure demonstrate the through flow pattern 705 wherein the passage between the upstream 157 section and the downstream 159 section of the inner flow passage 152 is not restricted whereas the passage between the inner flow passage 152 and the annular flow passages is restricted.

Detail (B1) is a section view and detail (B2) is a prospective cutaway view of the valve 220 in one state where the rotatable element 300 is in a position such that one portion of the inner flow passage 152 is connected with the annular flow passage 154 by way of aligning the outer surface 340 such that it does not obstruct flow passage between one portion of the inner flow passage 152 and the annular flow passage 154 through the lateral hole 210. The rotatable element 300 in this position further restrict flow passage within the inner flow passage 152 between the upstream 157 section and downstream 159 section passages by way of aligning the outer surface 340 to such that the inner flow passage 152 between the upstream 157 section and downstream 159 section is obstructed. This figure demonstrate the diverted flow pattern 710 wherein the flow passage between the upstream 157 section and the annular flow passage 154 is not restricted whereas the flow passage to the downstream 159 section is restricted.

Detail (C1) is a section view and detail (C2) is a prospective cutaway view of the valve 220 in one state where the rotatable element 300 is in a position such that the inner flow passage 152 is connected with the annular flow passage 154 through the lateral hole 210 by way of aligning the rotatable element 300 outer surface 340 such that it does not obstruct flow passage between the inner flow passage 152 and the lateral hole 210. The rotatable element 300 in this position further does not restrict flow passage within the inner flow passage 152 between the upstream 157 section and downstream 159 section passages by way of aligning the outer surface 340 such that the inner flow passage 152 between the upstream 157 section and downstream 159 section is not obstructed. This figure demonstrate the full flow pattern 715 wherein the flow passage between the upstream 157 section and the downstream 159 section of the inner flow passage 152 is not restricted and the flow passage between the inner flow passage 152 and the annular flow passages is not restricted.

FIG. 10 is a detailed view of a preferred embodiment of the valve 220 presented in different states by way of showing the rotatable element 300 in different positions. In this figure, the rotatable element 300 is in the form of a three ports rotatable element 330. Detail (AI) is a section view and detail (A2) is a prospective cutaway view and detail (A3) is an exploded view of the valve 220 in one state where the rotatable element 300 is in a position such that it restricts flow passage between the inner flow passage 152 and the annular flow passage 154 by way of aligning the outer surface 340 to obstruct the flow passage between the inner flow passage 152 and the lateral hole 210. The rotatable element 300 in this position does not restrict flow passage within the inner flow passage 152 between the upstream 157 section and downstream 159 section by way of aligning the outer surface 340 such that the inner flow passage 152 between the upstream 157 section and downstream 159 section is not obstructed. This figure demonstrate the through flow pattern 705 wherein the passage between the upstream 157 section and the downstream 159 section of the inner flow passage 152 is not restricted whereas the passage between the inner flow passage 152 and the annular flow passages is restricted.

Detail (B1) is a section view and detail (B2) is a prospective cutaway view and detail (B3) is an exploded view of the valve 220 in one state where the rotatable element 300 is in a position such that one portion of the inner flow passage 152 is connected with the annular flow passage 154 by way of aligning the outer surface 340 such that it does not obstruct flow passage between one portion of the inner flow passage 152 and the annular flow passage 154 through the lateral hole 210. The rotatable element 300 in this position further restrict flow passage within the inner flow passage 152 between the upstream 157 section and downstream 159 section passages by way of aligning the outer surface 340 to such that the inner flow passage 152 between the upstream 157 section and downstream 159 section is obstructed. This figure demonstrate the diverted flow pattern 710 wherein the flow passage between the upstream 157 section and the annular flow passage 154 is not restricted whereas the flow passage to the downstream 159 section is restricted.

Detail (C1) is a section view and detail (C2) is a prospective cutaway view and detail (C3) is an exploded view of the valve 220 in one state where the rotatable element 300 is in a position such that the inner flow passage 152 is connected with the annular flow passage 154 through the lateral hole 210 by way of aligning the rotatable element 300 outer surface 340 such that it does not obstruct flow passage between the inner flow passage 152 and the lateral hole 210. The rotatable element 300 in this position further does not restrict flow passage within the inner flow passage 152 between the upstream 157 section and downstream 159 section passages by way of aligning the outer surface 340 such that the inner flow passage 152 between the upstream 157 section and downstream 159 section is not obstructed. This figure demonstrate the full flow pattern 715 wherein the flow passage between the upstream 157 section and the downstream 159 section of the inner flow passage 152 is not restricted and the flow passage between the inner flow passage 152 and the annular flow passages is not restricted.

Figure 11A:
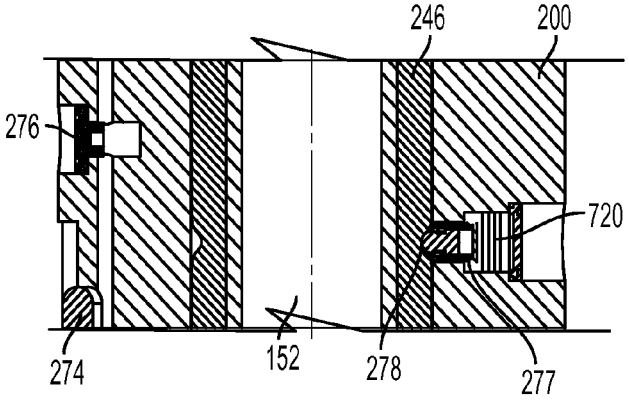
FIG. 11 is a section view of a possible embodiment of the activator when the flow control apparatus is in disabled mode as in detail (a), and in enabled mode as in detail (b) and detail (c)
Figure 11B:
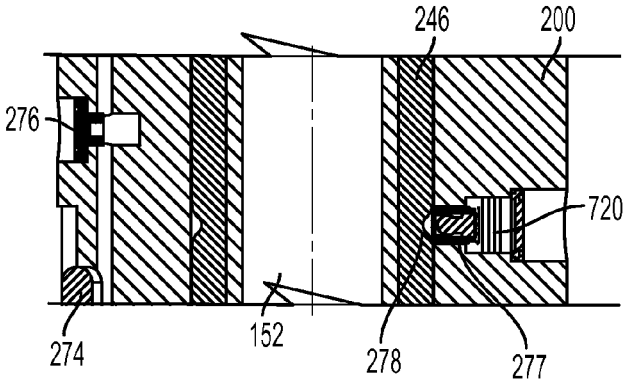
Figure 11C:
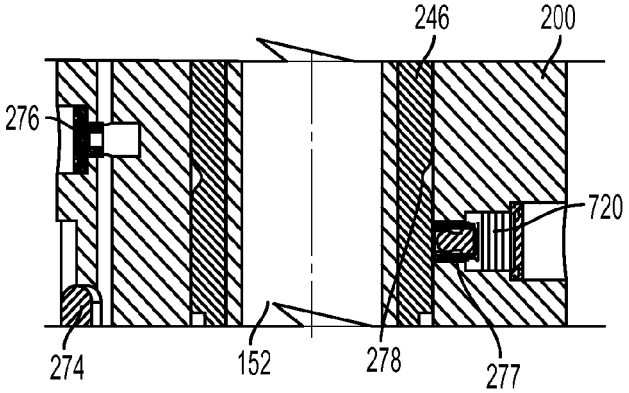

FIG. 11 is a section view of a possible embodiment of a locking means to cause the flow control apparatus 150 into enabled mode or disabled mode. By way of example the locking means comprising at least two elements. One element is a lock 277 element and the other element is a locking profile such as a locking groove 278. One of the elements is disposed in a suitable location within the body 200 and the other element is disposed within a suitable location within an actuator 240 element. The lock 277 is further movable between at least two positions by means of a lock driver 720 suitable to change the lock 277 position from one position to another. Detail A is a section view of the lock 277 engaged with the locking groove 278. Detail B is a view of the lock 277 disengaged from the locking groove 278, and detail C is a view of the lock 277 disengaged from the locking groove 278 and the actuation mandrel 246 moved to a different position.

The lock 277 viewed in FIG. 11 is caused to change position by a suitable lock driver 720. The lock driver 720 in one embodiment is a suitable solenoid. In another embodiment the lock 277 viewed in FIG. 11 is driven by lock driver 720 in a form of a suitable motor. It is understood that the lock 277 can be driven by other suitable lock driver 720 to cause it to move between at least two positions such that, in one position is lock 277 is disengaged from the locking groove 278, and in another position the lock 277 is suitably engaged the locking groove 278. For example, when a suitable electric charge is connected to the solenoid, the solenoid becomes energized causing the lock 277 to retract into the body 200 and the lock 277 is caused to disengage away from the locking groove 278 causing the flow control apparatus 150 into enabled mode. The solenoid is operable such that when energized with a different charge the lock 277 is caused to extend into the inner wall of the body 200 and is caused to be suitably engaged with the locking groove 278 causing the flow control apparatus 150 into a disabled mode. The same function made by the solenoid means of lock driver 720 could be achieved by a suitable motor in another embodiment or another suitable means to cause the lock 277 to change position in a different embodiment.

When the lock 277 is engaged with the suitable locking groove 278 disposed within the actuation mandrel 246, it restricts the movement of the actuation mandrel 246 therefore restricting the movement of the actuation linkage 242 and therefore the movement of the rotatable element 300 is restricted and the valve 220 is restricted from changing its state and not operable into a different state. The flow control apparatus 150 is said to be in disabled mode when the valve 220 is not operable to a different state. When the lock 277 is disengaged from the locking groove 278, the actuator 240 mandrel disposed within the flow control apparatus 150 will not be restricted by the lock 277 element and the flow control apparatus 150 will be in enabled mode and the valve 220 will be operable into a different state. The flow control apparatus 150 is said to be in enabled mode when the valve 220 is operable to a different state. The locking means explained is by way of example.

Another possible embodiment of the lock 277 means is explained; in a different embodiment of the actuator 240 such as the embodiment in FIG. 6 where the actuator 240 comprises a suitable electric motor 620 is achieved by disconnecting the electric source form the electric motor 620 causing the electric motor 620 to be inoperable and accordingly the rotatable element 300 is restricted from changing position by means of the gear arrangement where the worm engaged with the pinion 420 act as a break when the worm gear 610 is not rotatable, and the flow control apparatus 150 is then said to be in the disabled mode. When the electric motor 620 is connected to the suitable electric energy source, it rotates in certain direction causing the worm gear 610 to rotate and resulting in a change of the rotatable element 300 position and the valve 220 is operable into a different state and the flow control apparatus 150 is said to be in enabled mode.

Figure 12A:
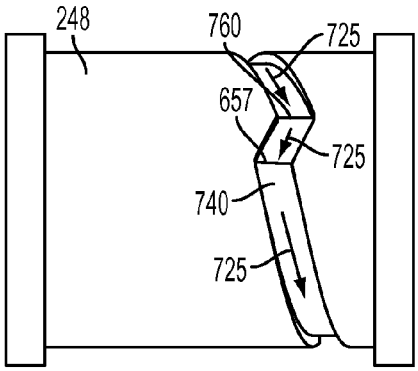
FIG. 12 is a barrel cam viewed from different angles in details (a), (b), (c) showing a possible cam track profile.
Figure 12B:
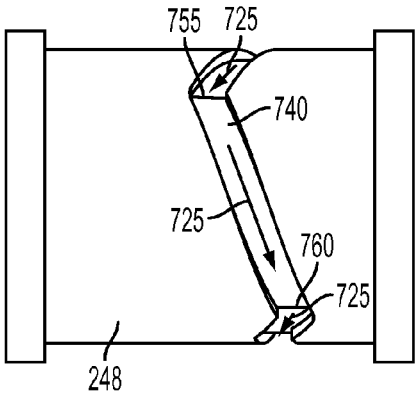
Figure 12C:
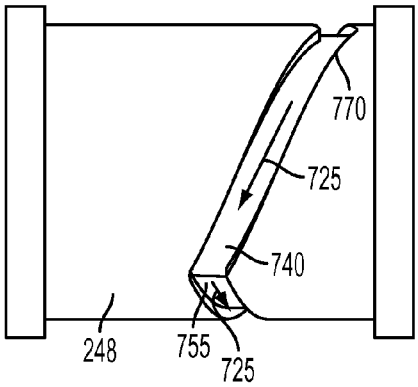

FIG. 12 is a view of barrel cam 248 viewed from different angles in details (A), (B), (C), showing a possible cam track 740 profile. The barrel cam 248 comprising a suitable cam track 740 disposed on a curved surface having plurality of stop points. A Cam follower 250 suitably disposed within the apparatus such that the cam follower 250 and the barrel cam 248 are movable to each other wherein either the cam follower 250 or the barrel cam 248 is restricted from moving in at least one direction with respect to the body 200. By way of example, the cam follower 250 in FIG. 2 is not movable with respect to the body 200 main axis that is parallel to the wellbore 100 axis, while the barrel cam 248 in FIG. 2 is movable with respect to the cam follower 250 when the actuation mandrel 246 moves within the body 200. The cam track 740 comprises at least one stop point 794 such that when the cam follower 250 traverses the cam track 740 in a traverse direction 725 and passes a stop point 794, the cam follower 250 will be restricted from traversing the cam track 740 in the opposite direction by restriction means such as a step within the cam track 740. In this example, while the barrel cam 248 is moving relative to the body 200, the cam follower 250 traverse the track in the traverse direction 725 from track point 1 755 to track point 2 760 then to track point 3 765 then to track point 4 770 and then continue traversing the cam track 740 to reach the starting track point 1 755. Throughout the barrel cam 248 movement is controlled by the cam track 740 profile and the cam follower 250, the axial and rotational movement of the barrel cam 248 suitably mounted on the actuation mandrel 246 result in a controlled movement of the actuation mandrel 246.

Figure 13:
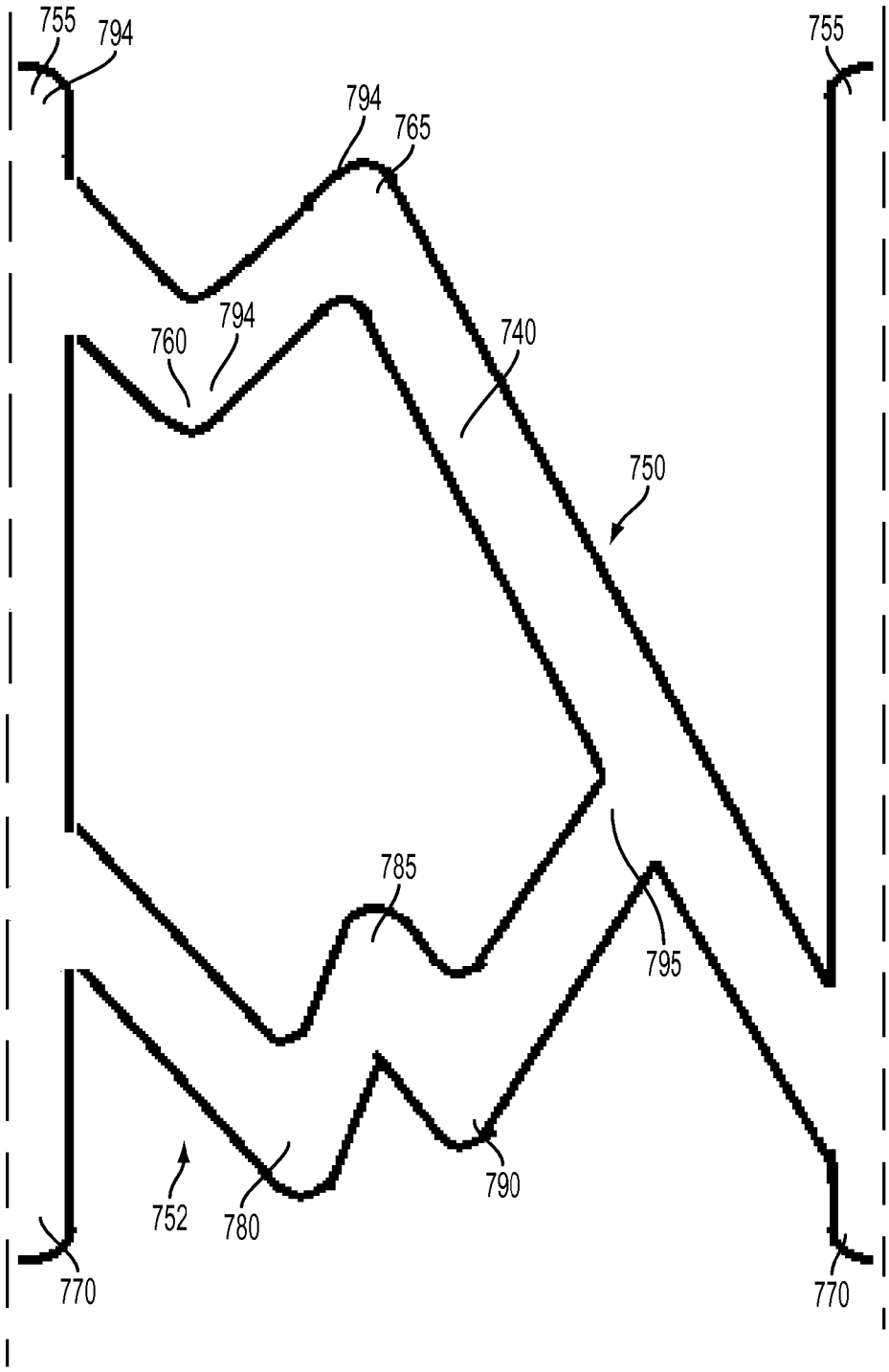
FIG. 13 is a detail view of a possible embodiment of barrel cam track with a plurality of track passage and a plurality of movement levels.

FIG. 13 is a view of a cam track 740 disposed in another possible embodiment having one or more cam track 740 by way of example herein as upper track 750 and lower track 752. Each of the upper track 750 and the lower track 752 having at least one stop point 794 suitably located onto the cam track 740 to cause the cam follower 250 traversing the cam track 740 to have plurality of possible combinations of sequence of stop points. In this figure when the cam follower 250 traverse the upper track 750 starting from track point 1 755 then track point 2 760 followed by track point 3 765 and track point 4 770 to then to track point 1 755 when the cam follower 250 fully travers the upper track 750. The cam follower 250 could be suitably controlled to traverse the lower track 752 starting from track point 1 755 then track point 5 780 followed by track point 6 785 then track point 7 790 then track point 8 795 then track point 4 770 and then back to the starting point at track point 1 755 when the cam follower 250 complete the traverse of the lower track 752. It is understood that this figure demonstrate by way of example possible combination of stop points in a cam track 740 where the cam follower 250 traversing the upper track 750 in this example passes by a total of four track stop points, while traversing the lower track 752, the cam follower 250 would pass by 6 track stop points before complete the lower track 752 to the starting point. This form of multi cam track 740 is advantageous and desirable in control systems. It is understood that plurality of tracks and plurality of track stop points are possible using this concept.

Figure 14:
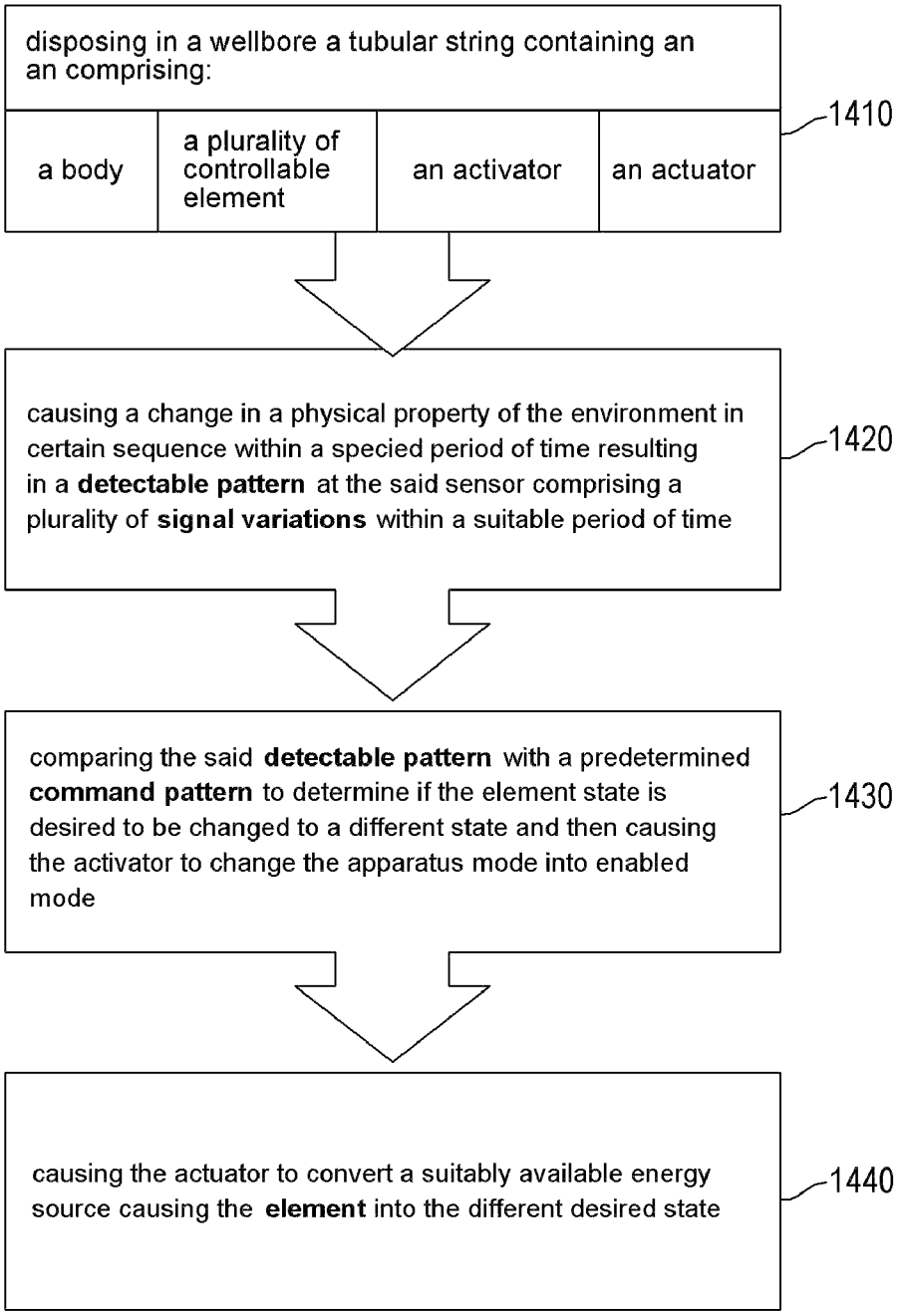
FIG. 14 is a flowchart of the disclosed method describing the steps suitable for remotely and selectively controlling an apparatus disposed in a wellbore.

FIG. 14 is a flow chart describing the steps used in the disclosed method for remotely and selectively controlling an apparatus disposed within a wellbore 100 comprising a body 200, a plurality of controllable element and activator 270 and an actuator 240 by means of causing a change in at least one physical property of the environment in certain sequence within a specified period of time resulting in a detectable pattern of signal variations within the apparatus comprising plurality of signal variations within a suitable period of time. The detectable pattern is further compared with a predetermine pattern called a command pattern 899 to determine whether a controllable element state within the apparatus is desired to be changed and then cause the activator 270 to change the apparatus mode into enabled mode. The actuator 240 is then caused to transform a suitably available energy source to cause the controllable element into the different state.

Figure 15:
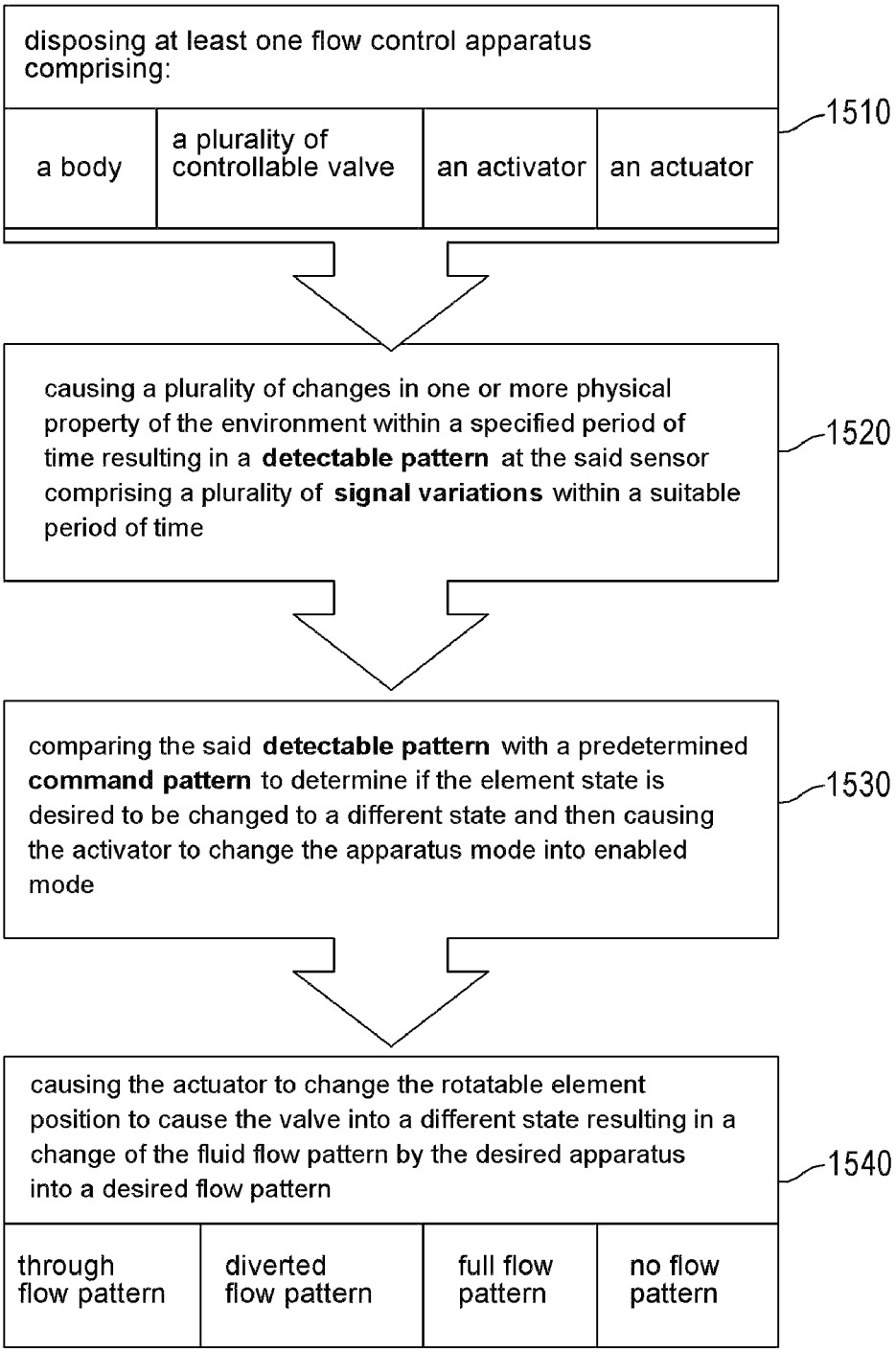
FIG. 15 is a flowchart of the disclosed method describing the steps for selectively and remotely controlling a flow passage causing desired flow pattern within a wellbore.

FIG. 15 is a flowchart of the disclosed method for selectively and remotely controlling a flow passage causing desired flow pattern within a wellbore 100 through disposing an apparatus comprising a body 200, a plurality of controllable valve 220, an activator 270 and an actuator 240 by means of causing a change in at least one physical property of the environment in certain sequence within a specified period of time resulting in a detectable pattern of signal variations within the apparatus comprising plurality of signal variations within a suitable period of time. The detectable pattern is further compared with a predetermine pattern called a command pattern 899 to determine whether a controllable valve 220 state within the apparatus is desired to be changed and then cause the activator 270 to change the apparatus mode into enabled mode. The actuator 240 is then caused to transform a suitably available energy source to cause the controllable valve 220 into the different state suitable to change the flow pattern into the desired flow pattern. A flow pattern can take any of the flowing patterns, no flow, full flow, a diverted flow and a through flow as explained in FIGS. 7, 8, 9, and 10.

Figure 16:
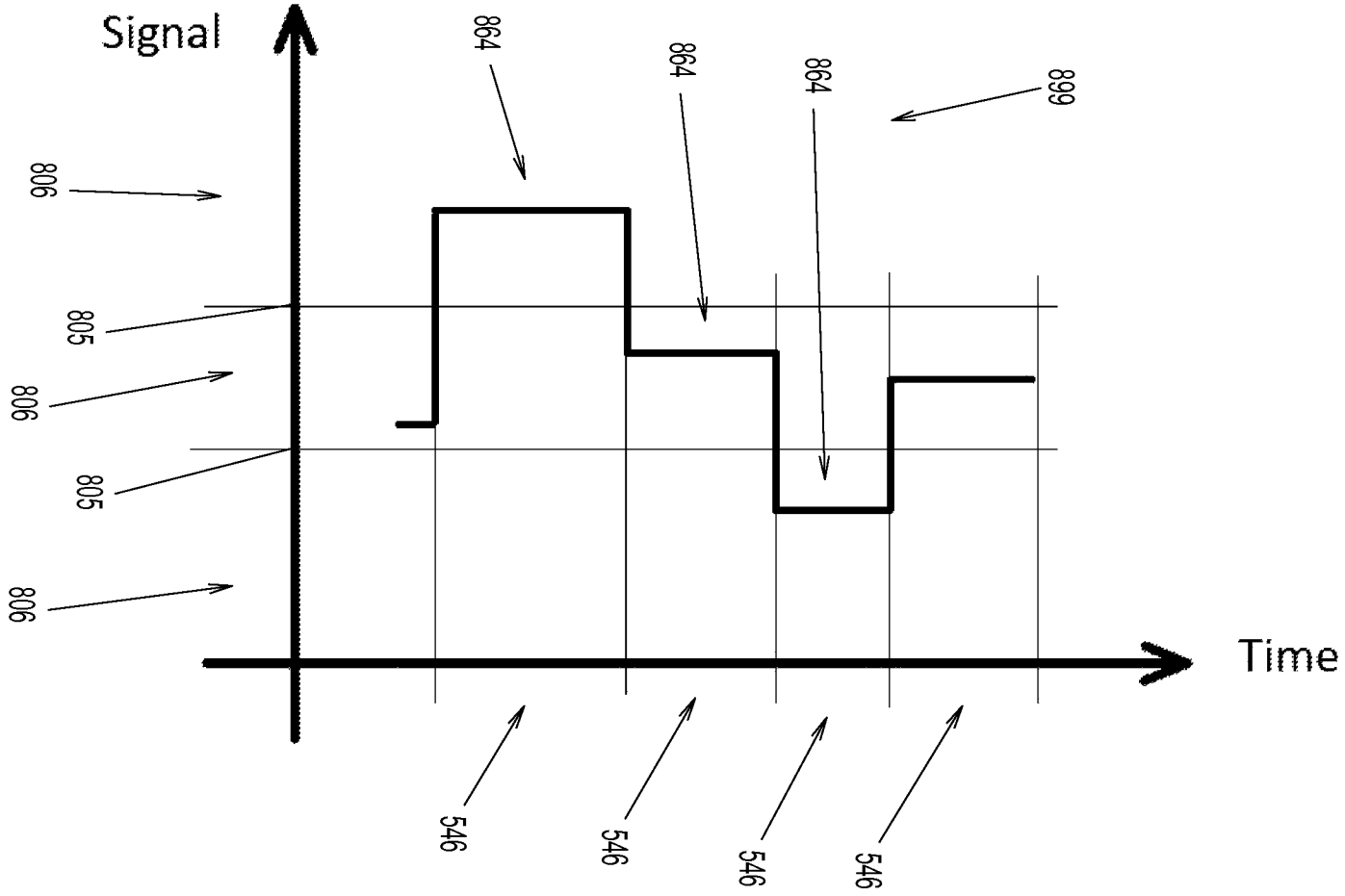
FIG. 16 is a diagram of a possible form of signal pattern comprising a sequence of signal variations over a period of time.

FIG. 16 is a diagram of a possible form of signal pattern comprising a sequence of signal variations over a period of time. This diagram is aimed to aid understanding the terms used in subsequent description in this disclosure. A signal level point 805 is any possible value of a signal. A signal level zone 806 is defined as any signal value within suitable two signal points defining the signal level zone 806 boundaries. A time period is referenced to as the period of time between any two time points. A time zone 546 is defined as the time period when the signal value stays within a signal level zone 806. When a signal value is changed to a different signal level zone 806, a different time zone 546 is defined. A signal is said to have a possible reference pattern 864 if its value stays within a particular signal level zone 806 for a specific time zone 546.

Figure 17:
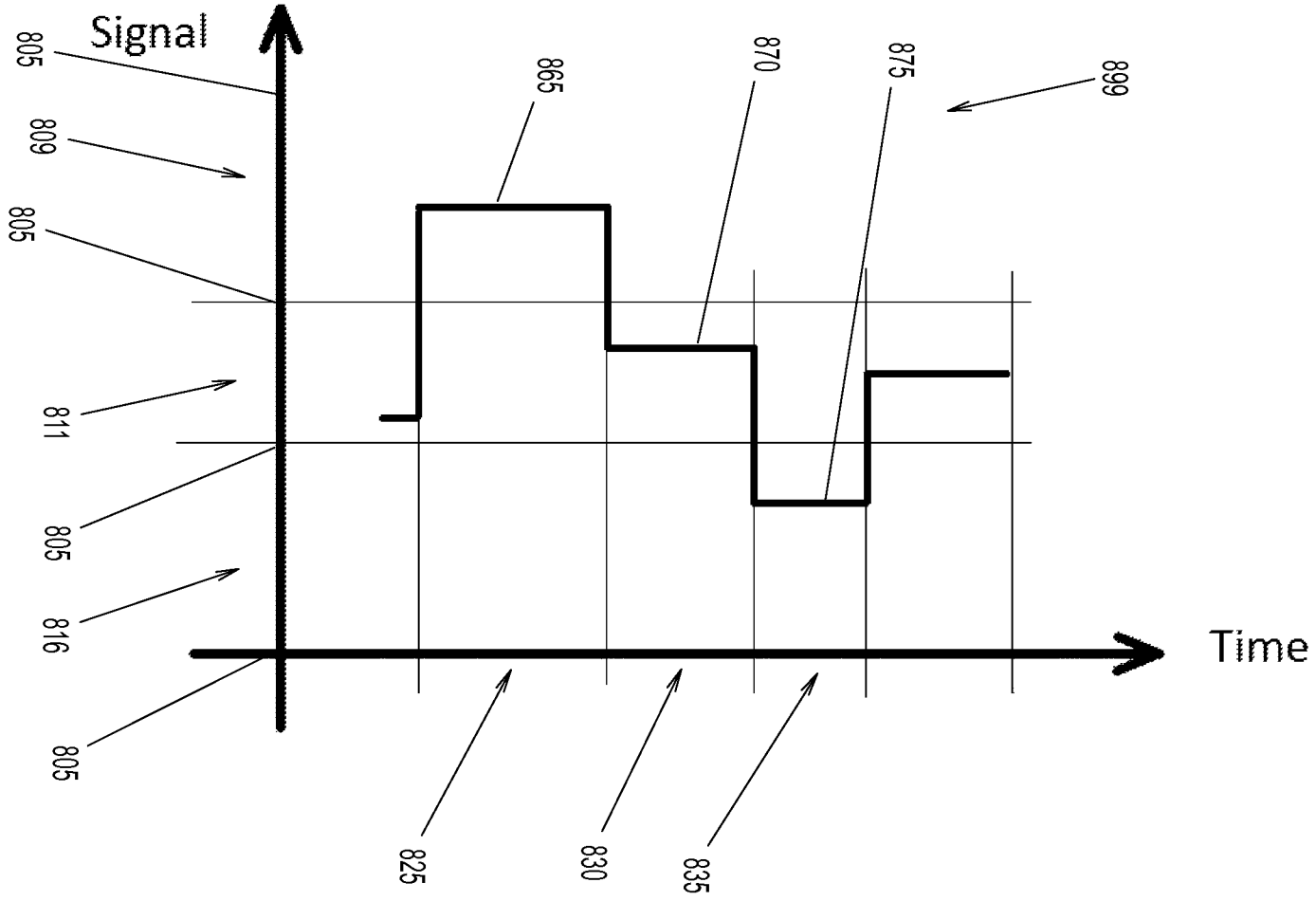
FIG. 17 is a diagram of a possible form of reference pattern comprising a predetermined set of signal variations within a specific period of time.

FIG. 17 is a diagram of a possible sequence of plurality of possible reference pattern 864. For example, a reference pattern A 865 is defined for the signal value within signal level zone 1 809 and for a time zone A 825, and a reference pattern B 870 is defined for the signal value within signal level zone 2 811 and for a time zone B 830, similarly a reference pattern C 875 is defined for the signal value within signal level zone 3 816 and for a time zone C 835.

Figure 18:
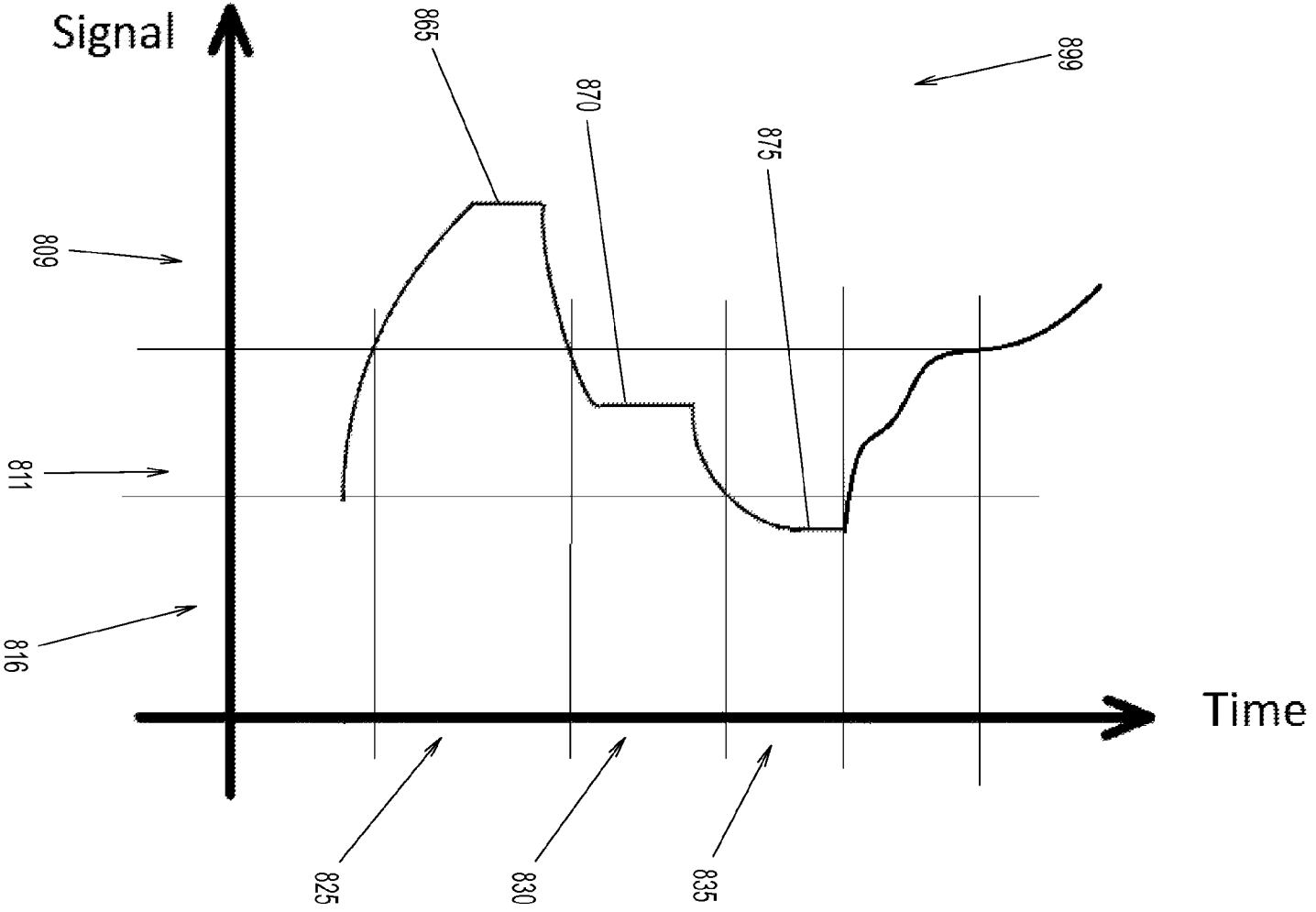
FIG. 18 is a diagram of a possible form of signal variations within a suitable period of time acceptable as matching with the reference pattern.

FIG. 18 is a diagram of another possible signal pattern processed or interpreted as having the sequence of a reference pattern A 865, a reference pattern B 870, and a reference pattern C 875. a signal is said to have other pattern 880 if it stays within a particular signal level zone 806 for other time zone 840 not matching those defined by reference pattern A 865, or reference pattern B 870 or reference pattern C 875.

Figure 19:
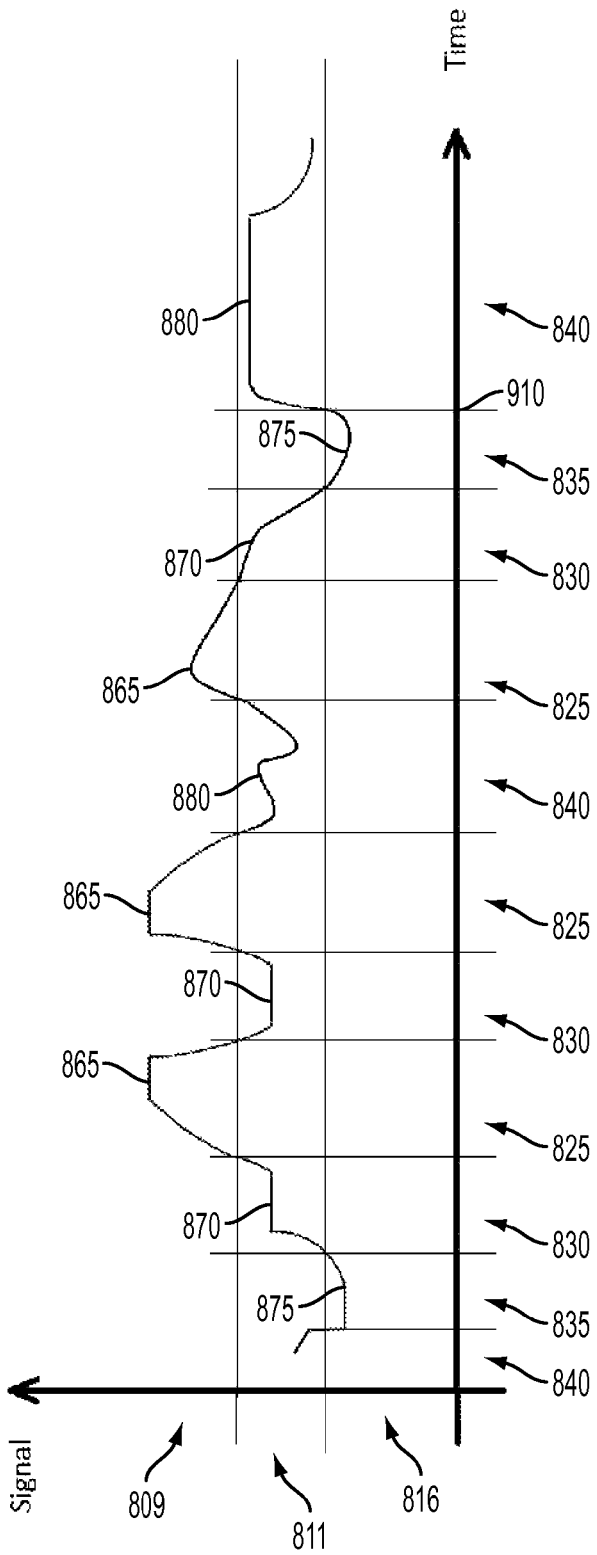
FIG. 19 is a diagram of a possible form of detectable patter of signal variations within a suitable period of time having a possible form of matching pattern to the reference patter.

FIG. 19 is a diagram of a possible sequence of plurality of possible reference patterns. In chronological order the activator 270 processor will interpret the sensor 272 signal by referring to reference pattern A 865, reference pattern B 870, reference pattern C 875, and other pattern 880 as follows: a reference pattern C 875, then a reference pattern B 870, then a reference pattern A 865, then a reference pattern B 870, then a reference pattern A 865 then other pattern 880 then a reference pattern A 865, then a reference pattern B 870, then a reference pattern C 875, then other pattern 880.

Figure 20A:
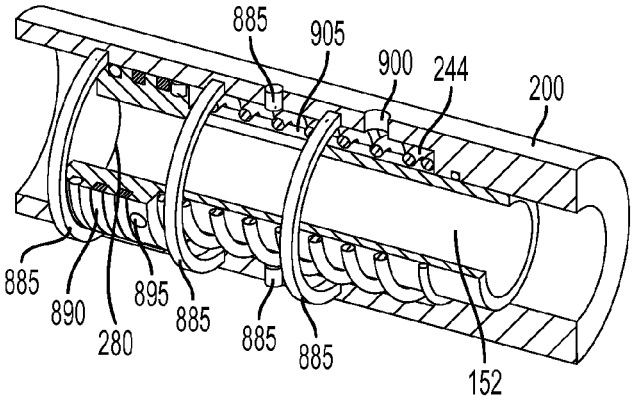
FIG. 20 is a detailed prospective cutaway view of a possible embodiment of an a means for transforming hydraulic energy from fluid in the wellbore into electric energy source suitable for operating the valve, or a mechanical movement directly into making a suitable movement of the rotatable element.
Figure 20B:
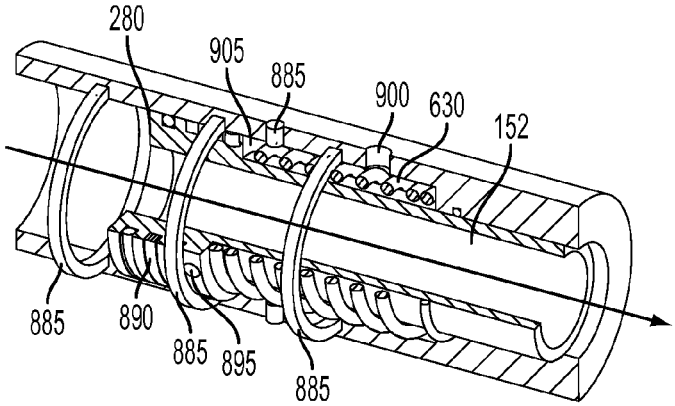
Figure 20C:
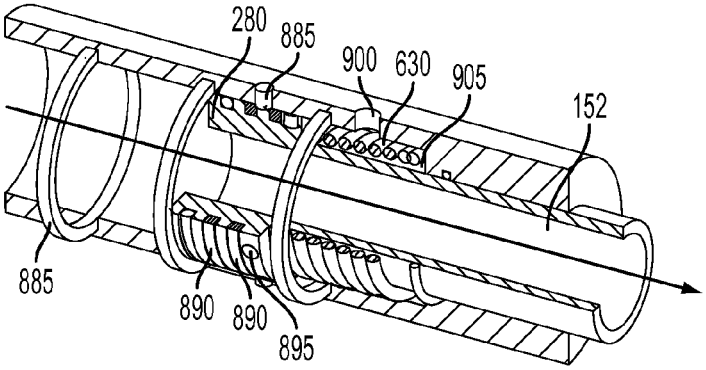

FIG. 20 is a detailed prospective cutaway view of a possible embodiment of an actuator 240 having a means for transforming hydraulic energy from fluid in the wellbore 100 into electric energy source. An actuation mandrel 246 is disposed within the body 200 inner space having a flow orifice 280 and inner surface and outer surface 340. A mud compartment 905 defined as the space between the inner body 200 surface and the actuation mandrel 246 outer surface 340 is having a suitably diameter at one end larger than the diameter on the other end and having at least one generator port 900 suitable for connecting fluid within the mud compartment 905 to fluid in the annular passage. The different inner diameter of the mud compartment 905 is such that when the actuation mandrel 246 moves in certain direction will cause the volume of mud compartment 905 to change. A suitable seal element is disposed within the mandrel and body 200 to restrict hydraulic communication between inner flow passage 152 and mud compartment 905. A suitable form of resilient element is disposed within the mud compartment 905 such as a coil spring 244 wherein the movement of the actuation mandrel 246 in certain direction will cause a change in the strain of the spring 244 and the move of the actuation mandrel 246 in a different direction will cause another change in the strain of the spring. One or more electric coil 885 is disposed within the present invention and one or more magnet is further disposed within the present invention such that movement of the actuation mandrel 246 within the body 200 will cause the relative location between the magnet and the electric coil 885. In this figure, different forms of magnets are presented by way of example such as stud magnet 895 and ring magnet 890. An example of different form of a suitable electric coil 885 is also presented having different shapes as in figure. Detail (A) is a view of the apparatus during no circulation. Detail (C) is a view of the apparatus during mud circulation. Detail (B) is a view of the apparatus during transition between no circulation and mud circulation.

By way of referring to wellbore 100 operation, and tubular string 110 disposed within a wellbore 100 comprising a drill bit 120, a bottom hole assembly 130, a plurality of flow control apparatus 150 and drill pipe 140. Drilling risks encountered during wellbore 100 operations include by way of examples having cutting beds 175, having suspended cuttings 170 in the well bore or having fluid losses into porous formation or fractures 160. It is desirable to change annular flow velocity at certain points within the wellbore 100 to improve hole cleaning by way of causing the cutting beds 175 and suspended cuttings 170 to move up the wellbore 100 annular passage to surface. It is further desirable to dispose certain fluid composition such as materials and chemicals to treat formation damage and reduce fluid losses. It is further desirable to introduce cement composition in a suitable form for treating a wellbore 100 fracture through the wellbore 100 to plug the formation fractures 160 without flowing the cement through the bottom hole assembly 130 components. It is further desirable to control flow pattern within the wellbore 100 and between inner flow passage 152 and annular passage at different points within the tubular string 110 to deal with one or more of the drilling operations risks encountered.

During customary drilling operation such as when the drill bit 120 cuts and removes new formation at the bottom of the well and enlarging the wellbore 100, it is further desirable to have continuous mechanical access through the inner flow passage 152 to enable running wireline services such as gyro survey to evaluate the well directional information. It is further desirable to dispose a drop ball activated equipment such as under reamers within the same tubular string 110. It is further desirable to enable the operator to use optimized drilling parameters such as varying flow rate or drilling with high pressure without undesirably causing the flow control apparatus 150 into a different mode. It is further desirable to dispose plurality of flow control apparatus 150 within the same tubular string 110 at various points and operate each one individually and selectively. It is further desirable to operate the flow control apparatus 150 to cause plurality of fluid flow pattern including one or more of the following flow patterns: through flow, lateral flow, full flow or no flow. It is further desirable to dispose the flow control apparatus 150 within the tubular string 110 such that mechanical restrictions within the inner flow passage 152 caused by other components of the tubular string 110 disposed between the flow control apparatus 150 and surface does not restrict the operation of the flow control apparatus 150. It is further desirable to operate the flow control apparatus 150 efficiently independent of the depth or the deviation of the point where the flow control apparatus 150 is disposed with respect to the tubular string 110.

The present invention introduces an apparatus and method to address some or all of the above desirables without the need to pull the tubular string 110 out of the wellbore 100 and resulting in a substantial savings of operation time and reduce operating cost.

An apparatus for remotely and selectively control fluid flow in tubular strings and wellbore annulus 156, comprising:

a body 200 defining the boundaries between an inner flow passage 152 through the apparatus and an annular flow passage 154 within the wellbore annulus 156 and having two suitable end connections and at least one lateral hole 210 suitable for connecting the inner flow passage 152 and the annular flow passage 154;

a controllable valve 220 operable in plurality of desired states altering the fluid flow pattern within the wellbore 100 wherein the valve 220 is having at least one rotatable element 300 wherein the element is rotatable to plurality of desired positions. The valve 220 further divides the inner flow passage 152 into upstream 157 section and downstream 159 section wherein upstream 157 section is defined as the portion of the inner flow passage 152 from the valve 220 and through the upstream 157 end connection 155 of the flow control apparatus 150 and the downstream 159 section as defined as the portion of the inner flow passage 152 from the valve 220 and through the downstream 159 end connection 155 of the body 200;

an activator 270 disposed within the body 200 capable of selectively change the apparatus in either one of two modes: a disabled mode wherein the valve 220 is not operable, and an enabled mode wherein the valve 220 is operable to a different state, comprising a means for detecting an intended change in the environment; and an actuator 240 capable of changing the rotatable element 300 position to cause the valve 220 into a desired state comprising a means for transforming a suitably available energy source into a mechanical movement;

The rotatable element 300 is suitably selected to cause the valve 220 into a suitable state and to cause a change of the flow pattern into one or more of the following patterns:

a no flow pattern wherein the flow passage between the upstream 157 section and the downstream 159 section is restricted and the flow passage between the inner flow passage 152 and the annular flow passage 154 is also restricted and the valve 220 is in no flow state;

a through flow pattern 705 wherein the passage between the upstream 157 section and the downstream 159 section of the inner flow passage 152 is not restricted whereas the passage between the inner flow passage 152 and the annular flow passages is restricted and the valve 220 is in through flow state;

a diverted flow pattern 710 wherein the flow passage between the upstream 157 section and the annular flow passage 154 is not restricted whereas the flow passage to the downstream 159 section is restricted and the valve 220 is in diverted flow state;

a full flow pattern 715 wherein the flow passage between the upstream 157 section and the downstream 159 section of the inner flow passage 152 is not restricted and the flow passage between the inner flow passage 152 and the annular flow passages is not restricted and the valve 220 is in full flow state. The rotatable element 300 having a suitable embodiment explained by way of example in FIG. 3. The activator 270 further comprises a plurality of suitable sensor 272 means for detecting an intended change in at least one physical property of the environment resulting in a signal within the apparatus suitable for processing. By way of example, in one embodiment of the apparatus, the sensor 272 means is a form of pressure sensor 272 suitable to be affected by pressure variation within the wellbore 100 caused by way of example by a change of depth or change of fluid flow pressure. In another embodiment the sensor 272 means is a flow sensor 272 suitable to be affected by variation of flow property such as fluid flow rate within the wellbore 100. In another embodiment the sensor 272 means is a form of an electrode suitable for detecting an electrical signal such as a change of the potential voltage or electric current of the electrode with respect to the tubular string 110 caused by an induced electric signal into the formation. In another embodiment the sensor 272 means is a form of an accelerometer affected by change of tubular string 110 movement in one or more direction such as the rotation speed or axial movement speed or any combination thereof. In another embodiment the sensor 272 means is a form of magnetometer affected by magnetic field changes due to change of surrounding magnetic conductivity of the environment at the apparatus caused by change of the detected signal of earth magnetic field in certain pattern caused induced by a change of the apparatus location in earth by way of moving the tubular string 110. It is understood that the sensor 272 means could take any other form suitable for detecting at least one change of the environment at the apparatus. The activator 270 further comprises a controller 274 means disposed within the flow control apparatus 150 in a form suitable for processing the signal generated by the sensor 272 means explained above.

The controller 274 means is capable of comparing the detected signal pattern to a predetermined command pattern 899. When a command pattern 899 is detected, the controller 274 means causes the suitable change within the apparatus to cause the desire change of the apparatus mode then to cause the change of the controller 274 to make the suitable changes within the apparatus to change the controllable valve 220 into the desired state. The controller 274 further comprises a movement limiting means to limit the actuation linkage 242 movement and cause it to stop at a desired displacement. By a way of example, movement limiting means of movement control include a barrel cam 248 disposed within the body 200 and suitably connected to the actuation mandrel 246. The barrel cam 248 comprises a cam track 740 with a profile suitable for the cam follower 250 disposed within the body 200 to limit the movement of the barrel cam 248 travel between specific predetermined two or more track point such as those explained in FIG. 12 and FIG. 14. Any of the track point restricts the barrel cam 248 displacement from movement in one or more direction. As the barrel cam 248 is suitably connected with the actuation mandrel 246, when the flow control apparatus 150 is in enabled mode, the movement of the barrel cam 248 as determined by the cam follower 250 traversing the cam track 740 causing the actuation mandrel 246 movement to be restricted to move to a specific position.

The activator 270 further comprises a locking means suitable for selectively change the apparatus mode when it is desired to change the apparatus mode to an enabled mode or to a disabled mode. By way of example the locking means comprises a lock 277 element such that when engaged with a suitable locking groove 278 suitably connected with the actuation mandrel 246, restrict the movement of one or more of the actuator 240 elements such as the actuation mandrel 246 and cause the flow control apparatus 150 to be in a disabled mode. When the apparatus is in disabled mode, the valve 220 is not operable to change its state. When the lock 277 is disengaged from the locking groove 278, the actuator 240 disposed within the flow control apparatus 150 will not be restricted by the lock 277 element and the flow control apparatus 150 will be in enabled mode and the valve 220 will be operable into a different state.

In a possible embodiment as described in FIG. 11, the lock 277 is caused to change position by a suitable lock driver 720. The lock driver 720 in one embodiment is a suitable solenoid. In another embodiment the lock 277 viewed in FIG. 11 is driven by lock driver 720 in a form of a suitable motor. It is understood that the lock 277 can be driven by other suitable lock driver 720 to cause it to move between at least two positions such that, in one position is lock 277 is disengaged from the locking groove 278, and in another position the lock 277 is suitably engaged the locking groove 278. In one embodiment where the lock driver 720 is a solenoid, for example, when a suitable electric charge is connected to the solenoid, the solenoid becomes energized causing the lock 277 to retract into the body 200 and the lock 277 is caused to disengage away from the locking groove 278 causing the flow control apparatus 150 into enabled mode.

The solenoid is further operable such that when energized with a different suitable charge the lock 277 is caused to extend through the inner wall of the body 200 and is caused to be suitably engaged with the locking groove 278 causing the flow control apparatus 150 into a disabled mode. The same function made by the solenoid means of lock driver 720 could be achieved by a suitable motor in another embodiment. It is understood that the locking means by way of example and does not limit the apparatus locking to these mentioned embodiments. When the lock 277 is engaged with the suitable locking groove 278 disposed within the actuation mandrel 246, it restricts the movement of the actuation mandrel 246 therefore restricting the movement of the actuation linkage 242 and therefore the movement of the rotatable element 300 is restricted and the valve 220 is restricted from changing its state and not operable into a different state.

The flow control apparatus 150 is said to be in disabled mode when the valve 220 is not operable to a different state. When the lock 277 is disengaged from the locking groove 278, the actuator 240 mandrel disposed within the flow control apparatus 150 will not be restricted by the lock 277 element and the flow control apparatus 150 will be in enabled mode and the valve 220 will be operable into a different state. The flow control apparatus 150 is said to be in enabled mode when the valve 220 is operable to a different state. The locking means explained is by way of example. Another possible embodiment of the locking means is explained; in a different embodiment of the actuator 240 such as the embodiment in FIG. 6 where the actuator 240 comprises a suitable electric motor 620, the locking means is achieved by disconnecting the electric energy source form the electric motor 620 causing the electric motor 620 to be inoperable and accordingly the rotatable element 300 to be restricted from changing position by means of the gear arrangement where the worm engaged with the pinion 420 act as a break when the worm gear 610 is not rotatable, and the flow control apparatus 150 is then said to be in the disabled mode. When the electric motor 620 is connected to the suitable electric energy source, it rotates in a suitable direction causing the worm gear 610 to rotate causing the pinion 420 to rotate in a suitable direction and resulting in a change of the rotatable element 300 position and the valve 220 is operable into a different state and the flow control apparatus 150 is said to be in enabled mode during when the electric energy source is connected to the motor.

The flow control apparatus 150 further comprises an actuator 240 capable of changing the rotatable element 300 position to cause the valve 220 into a desired state therefore causing a change in flow pattern comprising a means for transforming a suitably available energy source into a mechanical movement. In one embodiment, the actuator 240 comprises a form of an electric motor 620 powered by a suitable battery 276 or a suitable generator or capacitor or other suitable electric energy source disposed within the apparatus or available on a different location within the tubular string 110 or on surface and connected to the apparatus by connecting means such as wireline cable introduced form surface to the apparatus through wellbore 100. In this embodiment of actuator 240 having an electric motor 620 means of transforming a suitably available electrical energy source into a mechanical energy is capable of changing the position of the rotatable element 300 by means of linkage in the form of a suitable gear engagement such as worm gear 610 and pinion 420. When the electric energy source is connected to the electric motor 620 causing the worm gear 610 connected to the electric motor 620 output to adequately rotate the pinion 420 that is suitably connected to the rotatable element 300 around the pivot 307 and will cause a change of the rotatable element 300 position and accordingly a change of the controllable valve 220 state and a suitable change of the flow pattern.

In another embodiment the actuator 240 transforms an energy source in the form of an energized resilient element such as a spring 244. The resilient element stores energy when caused to change its state from relaxed state to a strained state alternatively called an energized state by means of causing a strain to the resilient element such as by means of coiling, compressing or stretching the resilient element from a less strained state. The resilient element in such a strained state when suitably connected to the rotatable element 300 and when the apparatus is in enabled mode, will cause the rotatable element 300 into a different position. In another embodiment, the form of resilient element energy source is pre-energized before disposing the flow control apparatus 150 into the wellbore 100.

In a further other embodiment the resilient element energy source is energized while within the wellbore 100 by another energy source such as hydraulic flow as explained in the embodiment viewed in FIG. 20. When the flow control apparatus 150 is enabled, stored mechanical energy disposed within the energized resilient element is allowed to relax to a less strain state by releasing strain energy into mechanical movement causing the worm gear 610 to adequately move the pinion 420 that is suitably connected to the rotatable element 300 around the pivot 307 and as a result changing the rotatable element 300 position. The example explained above of release strain energy stored in a resilient element is similar to the energy stored in a watch winding spring 244 explained in plurality of sighted patents such as U.S. Pat. No. 163,161 filed in 1874. A means of transforming mechanical energy source disposed within the apparatus in a form of and energized resilient element is explained. In a further possible embodiment, the actuator 240 comprises a means suitable to transform a form of mechanical energy source caused by an inertia mass element disposed within the flow control apparatus 150 into a mechanical movement suitable for changing the rotatable element 300 position. When the flow control apparatus 150 is in enabled mode, and when the inertia element 510 is suitably energized by way of momentum or inertia for example through movement of tubular string 110, the inertia element 510, suitably connected to the rotatable element 300 as explained earlier, will cause a change of the rotatable element 300 position and accordingly cause a change in the valve 220 state.

In a further other embodiment, the actuator 240 is suitable for transforming a hydraulic energy of the fluid flowing through the inner flow passage 152 or annular flow passage 154 or any combination thereof to generate a suitable mechanical energy causing the rotatable element 300 to change position explained herein. The practice of introducing drilling fluid composition into the tubular string 110 inner flow passage 152 will cause the fluid in the inner flow passage 152 to have higher pressure than the fluid in the annular flow passage 154 at the same depth, and the fluid is called to be circulated through the inner flow passage 152 and the operation is commonly called mud circulation. When no fluid is introduced into the tubular string 110 inner flow passage 152, the fluid pressure in the inner flow passage 152 will be similar to the fluid pressure in the annular flow passage 154 at the same depth and the operation is commonly called no circulation. The apparatus actuator 240 described in FIG. 20 harvest energy from the change of pressure between the inner flow passage 152 and the annular flow passage 154 at the apparatus depth during the mud circulation and stores it through deforming a resilient element such as the spring 244 shown in figure. The mud compartment 905 defined as the space between the inner body 200 surface and the actuating mandrel outer surface 340 is having a suitably varying diameter so that fluid pressure exerted on the flow orifice 280 during mud circulation that is higher than the fluid pressure in the mud compartment 905 causing the actuation mandrel 246 to move in the direction suitable to compress the spring 244. During no circulation the pressure in the mud compartment 905 is the same as the pressure in the inner flow passage 152 and the force exerted by the compressed spring 244 will be released causing the actuation mandrel 246 to move to the opposite direction. The actuator 240 is further having an arrangement of electric coils and magnets such as stud magnet 895 or ring magnet 890 or any combination thereof. When the actuation mandrel 246 moves with the effect of mud circulation in one direction and moves again at no circulation in the opposite direction it will cause a change of magnetic field detected by the electric coil 885 caused by the change of relative position of the electric coil 885 and the magnet element causing electric charges observed in the electric coil 885.

In a further possible embodiment of the present invention the electric charges is utilized to move the electric motor 620 and in a further possible embodiment, the electric charges is utilized to charge a suitable means of storing electric charge such as capacitor or rechargeable battery 276. A method of energy harvesting is now explained where electric energy is harvested from hydraulic energy within the wellbore 100, and a mechanical energy is harvested from hydraulic energy within the wellbore 100. It is understood that the energy sources explained herein are made by way of example and not exhaustive. The same function is possible to be achieved by other means of energy sources suitably available within the apparatus.

In a further possible embodiment, the actuator 240 comprises an actuation mandrel 246 having a suitable flow orifice 280 profile that is affected by fluid flowing through the inner flow passage 152. When fluid flows through the actuation mandrel 246 the hydraulic energy from the fluid flow exerts a suitable force on the flow orifice 280 causing the actuation mandrel 246 to move with respect to the body 200 and exerting a suitable force on the actuation linkage 242 suitably attached to the rotatable element 300 push-pull point 308 causing the rotatable element 300 to move and causing the rotatable element 300 to change its position.

The flow control apparatus 150 explained above is normally disposed in the wellbore 100 while in initial valve 220 state of through flow state. Customary drilling operation may take place by including the steps of drilling, flowing drilling fluid into the tubular inner flow passage 152, lowering the tubular string 110 deeper into the earth and extending deeper into the earth by way of removing layer of earth through drilling process by means of drill bit 120 operation. With reference to the preferred embodiment explained in FIG. 2, when the valve 220 state is through flow state as in detail A of FIG. 10, there is no restriction within the inner flow passage 152. When desired, it is possible in this state to run a suitable wireline services such as gyro survey through the tool inner flow passage 152. It is further possible to operate a drop ball operated device disposed within the tubular string 110 by means of introducing a suitable drop ball through the tubular string 110 inner flow passage 152 including the inner flow passage 152 portion through the flow control apparatus 150. When it is desired to change the flow pattern of a particular flow control apparatus 150 disposed within the tubular string 110, a suitable change in the environment is made causing a signal pattern to be detected within the apparatus.

A command pattern 899 is suitably formed sequence of signal pattern predetermined and stored within each tool and for each desired command. By way of example, a possible command pattern 899 to change a particular valve 220 disposed within a particular flow control apparatus 150 from one flow state to another flow state comprises the following sequence in order, reference pattern A 865 followed by reference pattern B 870 then followed by reference pattern C 875. A controller 274 disposed within the flow control apparatus 150 processing the signal detected within the apparatus will observe the command pattern 899 at command time point x. At command time point x, the activator 270 will cause the desired change within the apparatus to cause it into the desired mode. The activator 270 further will cause the actuator 240 to cause the controllable valve 220 into the desired state by changing the rotatable element 300 into the desired position by means of transforming a suitably available energy source as explained earlier into a mechanical movement. It is to note that a suitable command pattern 899 is predetermined for each flow control apparatus 150 disposed within the tubular string 110. This is another desired advantage of the present invention allowing user to dispose plurality of flow control apparatus 150 within the same tubular string 110 and cause each one individually and selectively into a possible independent valve 220 state and accordingly a suitable flow pattern. It is further to note that the command pattern 899 is suitably predetermined such that change of the environment caused during customary operations will not cause the flow control apparatus 150 to change its mode or flow pattern to change, this is another desirable advantage of the present invention such that optimal operating parameters is possible to be deployed without the risk of undesirably causing the flow control apparatus 150 to change its mode or flow pattern.

It is possible to extend and apply the same method of selectively controlling a flow control apparatus 150 using command pattern 899 to any other apparatus disposed within a tubular string 110 suitably equipped to detect such a command pattern 899 and cause the desired actuation to selectively take place. The example explained in FIG. 19 and detailed above for the flow control apparatus 150 could be implemented on any other suitably equipped apparatus having a device means suitable for any desired action such as a valve 220. The command pattern 899 explained and disclosed herein is another desirable advantage of the present invention as it provide extra flexibility of disposing plurality of apparatus each could have a different device means to perform a different function. Such a command pattern 899 provides an advantage means to enable the operator to selectively and remotely operate plurality of apparatus disposed within a wellbore 100 into a desired mode or a desired state independently.

Furthermore, and with reference to the flow control apparatus 150, when it is desirable to dispose a particular fluid composition to treat formation damage such as cement composition to treat formation fractures 160, it would be desirable to operate a flow control apparatus 150 dispose within the tubular string 110 between the bottom hole assembly 130 and surface and cause its valve 220 into bypass state. When in bypass state such as the state explained in FIG. 10 detail (B1) (B2) and (B3). It is to note that fluid composition will all exit the lateral hole 210 into the annular passage to reach the damage formation. It is to note that the inner flow passage 152 downstream 159 section of the valve 220 is obstructed in such a way that safeguard bottom hole assembly 130 components disposed between the drill bit 120 and the flow control apparatus 150 from having such a cement composition undesirably flowing into the bottom hole assembly 130 components.

It is a further advantage that the preferred embodiment explained in FIG. 2 utilizing the valve 220 detailed in FIG. 10 will allow the user to displace all treatment composition fluid within the inner flow passage 152 with another composition fluid without leaving any tangible volume of the treatment composition fluid within the inner flow passage 152. This is another advantage of the present invention whereas when it is desired to change the valve 220 state into through flow state after performing the disposition of treatment composition fluid into the annular passage, there will be no significant treatment composition fluid within the inner flow passage 152 that would enter the bottom hole assembly 130 inner flow passage 152 and will not be a source of risk to the bottom hole assembly 130 components. As the flow control apparatus 150 is rigidly attached to the tubular string 110 through the end connection 155 and the inner flow passage 152 is hydraulically connected to surface and the drilling fluid commonly used in drilling operations is relatively incompressible, causing any change on the surface by means of moving the tubular string 110 in any direction or causing the fluid flow to change in any particular pattern will cause a suitable change in the environment reasonably detectable by sensor 272 disposed within the flow control apparatus 150 nearly at the same time. This is another advantage of the present invention will save significant operating time when compared to a drop ball activated devices where the drop ball has to consume a significant time traversing the inner flow passage 152 from surface to reach its corresponding apparatus.

It is a further advantage of the present invention to be operated by causing a command pattern 899 within a similar time independent of the depth or location of the flow control apparatus 150, and independent of the well deviation anywhere in the wellbore 100 where the present invention is disposed of, particularly when compared to drop ball activated apparatus where the drop ball will take different time to reach the corresponding apparatus depending on that apparatus depth, and well deviation. It is a further advantage that the present invention command pattern 899 does not demand a physical access within the inner flow passage 152 allowing the operator to dispose the flow control apparatus 150 within the tubular string 110 below other devices that may have mechanical restriction within the inner flow passage 152 such a drop ball activated apparatus disposed between the flow control apparatus 150 and surface within the same tubular string 110. It is another further advantage that the present invention is operable in unlimited number of times and does not suffer from the limited number of operable cycles that is associated with drop ball activated apparatus imposed by what is called a ball capture means used commonly with apparatus using drop ball system.

It is another further advantage that the present invention is operable in one or more of the following flow states: through flow, diverted flow, full flow, and no flow explained earlier providing a far more flexibility to the operator. The through flow is commonly used in customary drilling operation. The diverted flow is of an advantage for composition fluid particularly when the composition is not suitable to pass through equipment disposed downstream 159 of the flow control apparatus 150, as by the way of example the disposition of cement composition to treat fractures 160 when equipment downstream 159 of the flow control apparatus 150 is a bottom hole assembly 130 component. The full flow pattern 715 is a useful pattern to suitably control or increase the annular fluid velocity aiding to improve hole cleaning and reduce cutting beds 175 and reduce suspended cuttings 170 within the wellbore annulus 156 while at the same time allow for portion of the circulated fluid to flow through the inner flow passage 152 and possibly through the bit perforations 125 to maintain well control at all times. The no flow mode is another important mode suitable for securing the well as a form of sub surface safety valve 220 and could be used in emergency cases where it is desired not to allow flow within the bottom of the well and the inner flow passage 152 such as situations when well control is compromised for example during what is call well kick or early warning of blowout.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

We claim:

1. An apparatus for remotely controlling fluid flow in tubular strings and wellbore annulus, comprising:

a. a body defining the boundaries between an inner flow passage through the apparatus and an annular flow passage within the wellbore annulus, the body comprising two ends and at least one lateral hole for connecting the inner flow passage and the annular flow passage;

b. a valve operable in plurality of predetermined states for altering fluid flow pattern, wherein the valve comprises at least one rotatable element movable to a plurality of predetermined positions, wherein the valve further divides the inner flow passage into an upstream section and a downstream section, wherein the upstream section is the portion of the inner flow passage from the valve and through one end of the body and the downstream section is the portion of the inner flow passage from the valve and through the other end of the body;

c. an activator disposed within the body for selectively changing the apparatus into either one of two modes: a disabled mode, wherein the valve is not operable, and an enabled mode, wherein the valve is operable to a predetermined state; and d. an actuator for changing the position of the rotatable element comprising a means for transforming an energy source into a mechanical movement;

wherein the activator is responsive to an intended change in the environment;

wherein the valve state is responsive to the rotatable element position; said rotatable element comprising at least one surface of spherical shape and at least two ports;

wherein the plurality of predetermined states comprise:

i. no flow state wherein the flow passage between the upstream section and the downstream section is restricted and the flow passage between the inner flow passage and the annular flow passage is restricted;

ii. through flow state wherein the passage between the upstream section and the downstream section is in fluid communication whereas the flow passage between the inner flow passage and the annular flow passage is restricted;

iii. diverted flow state wherein the flow passage between the upstream section and the annular flow passage is in fluid communication whereas the flow passage between the upstream section and the downstream section is restricted; and iv. full flow state wherein the flow passage between the upstream section and the downstream section is in fluid communication and the flow passage between the inner flow passage and the annular flow passages is in fluid communication.

2. The apparatus of claim 1, wherein the rotatable element comprising at least one cavity inside the element.

3. The apparatus of claim 1, further comprising a sensor means for detecting a plurality if intended changes in at least one physical property of the environment resulting in a detectable signal within the apparatus suitable for processing, wherein the sensor means comprising a sensor.

4. A method of remotely and selectively controlling an apparatus disposed in a tubular string within a wellbore, the method comprising steps of:

a. disposing in a wellbore a tubular string including an apparatus comprising:

i. a body;

ii. at least one controllable elements operable in a plurality of predetermined states;

iii. an activator disposed within the body capable of selectively change the apparatus in either one of two modes: a disabled mode wherein the controllable element is not operable, and an enabled mode wherein the controllable element is operable to a predetermined state, wherein the activator comprising a sensor responsive to an intended change in the environment, wherein the intended change in the environment is selected from the set comprising change of fluid property introduced from surface into the wellbore, change of pressure, change of temperature, change of flow rate, change of fluid density, change of fluid viscosity, change of fluid color, change of fluid composition, change of magnetic field or a physical change detectable by the sensor; and iv. an actuator for changing the controllable element into a predetermined state;

b. causing a change in a physical property of the environment in a predetermined sequence within a specified period of time resulting in a detectable pattern at the sensor, wherein the change in the physical property of the environment comprising a sequence of plurality of signal variations within the specified period of time;

c. comparing the detectable pattern with a command pattern to determine if the controllable element state is to be changed to a different predetermined state;

d. causing the activator to change the apparatus mode into the predetermined mode; and e. causing the actuator to use an energy source causing the at least one controllable element into a different predetermined state.

5. The method of claim 4 wherein the change in a physical property of the environment is a change of electric field detectable by the sensor.

6. A method for remotely and selectively control fluid flow in a tubular string and wellbore annulus, the method comprising the steps of:

a. disposing a tubular string into a wellbore comprising at least one flow control apparatus comprising:

i. a body defining the boundaries between an inner flow passage through the apparatus and an annular flow passage within the wellbore annulus, the body comprising two ends and at least one lateral hole for connecting the inner flow passage and the annular flow passage;

ii. a valve operable in plurality of predetermined states for altering fluid flow pattern, the valve comprising at least one rotatable element movable to a plurality of predetermined positions, wherein the valve further divides the inner flow passage into an upstream section and a downstream section, wherein the upstream section is the portion of the inner flow passage from the valve and through one end of the body and the downstream section is the portion of the inner flow passage from the valve and through the other end of the body;

iii. an activator disposed within the body for selectively changing the apparatus into either one of two modes: a disabled mode, wherein the valve is not operable, and an enabled mode, wherein the valve is operable to a predetermined state, and iv. an actuator for changing the position of the rotatable element;

wherein the activator is responsive to an intended change in the environment;

wherein the valve state is responsive to the rotatable element position;

wherein the predetermined states are selected from the set comprising:

1. no flow state wherein the flow passage between the upstream section and the downstream section is restricted and the flow passage between the inner flow passage and the annular flow passage is restricted;

2. through flow state wherein the passage between the upstream section and the downstream section is in fluid communication whereas the flow passage between the inner flow passage and the annular flow passage is restricted;

3. diverted flow state wherein the flow passage between the upstream section and the annular flow passage is in fluid communication whereas the flow passage between the upstream section and the downstream section is restricted; and 4. full flow state wherein the flow passage between the upstream section and the downstream section is in fluid communication and the flow passage between the inner flow passage and the annular flow passages is in fluid communication;

b. causing a plurality of changes in one or more physical property of the environment within a specified period of time resulting in a detectable pattern at the sensor comprising a plurality of signal variations within the specified period of time;

c. comparing the detectable pattern with a command pattern to determine if the valve state is to be changed to a different predetermined state and then causing the activator to cause the apparatus mode into the predetermined mode; and d. causing the actuator to change the rotatable element position to cause the valve into a different predetermined state resulting in a change of the fluid flow pattern by the valve from an initial predetermined flow pattern to a different predetermined flow pattern.

* * * * *